US011486156B2

(12) United States Patent
Rus

(10) Patent No.: US 11,486,156 B2
(45) Date of Patent: Nov. 1, 2022

(54) STAIR TREAD COVER

(71) Applicant: Garland Industries, Inc., Cleveland, OH (US)

(72) Inventor: Melissa Rus, Cleveland, OH (US)

(73) Assignee: GARLAND INDUSTRIES, INC., Cleveland, OH (US)

( * ) Notice: Subject to any disclaimer, the term of this patent is extended or adjusted under 35 U.S.C. 154(b) by 307 days.

(21) Appl. No.: 16/918,204

(22) Filed: Jul. 1, 2020

(65) Prior Publication Data

US 2020/0332543 A1 Oct. 22, 2020

Related U.S. Application Data

(60) Division of application No. 16/100,720, filed on Aug. 10, 2018, now Pat. No. 11,002,028, which is a continuation-in-part of application No. 15/995,435, filed on Jun. 1, 2018, now abandoned.

(60) Provisional application No. 62/513,682, filed on Jun. 1, 2017.

(51) Int. Cl.

| | |
|---|---|
| ***E04G 21/30*** | (2006.01) |
| ***E04F 11/17*** | (2006.01) |
| ***E04F 11/104*** | (2006.01) |
| ***E04F 11/16*** | (2006.01) |

(52) U.S. Cl.

CPC ..... *E04G 21/30* (2013.01); *E04F 11/104* (2013.01); *E04F 11/163* (2013.01); *E04F 11/17* (2013.01); *E04F 11/1042* (2013.01); *E04F 11/1043* (2013.01)

(58) Field of Classification Search

CPC ..... E04G 21/30; E04F 11/17; E04F 11/104; E04F 11/163; Y10S 52/12

See application file for complete search history.

(56) References Cited

U.S. PATENT DOCUMENTS

| | | | |
|---|---|---|---|
| 184,013 | A | 11/1876 | Krickl |
| 1,373,366 | A | 3/1921 | Stanwood |
| 2,106,399 | A | 1/1938 | Beaumont et al. |
| 2,288,470 | A | 6/1942 | Lorraine |
| D167,994 | S | 10/1952 | McKay |
| 2,835,937 | A | 5/1958 | Hobbs |
| 3,557,504 | A | 1/1971 | Graf |

(Continued)

FOREIGN PATENT DOCUMENTS

| | | |
|---|---|---|
| CA | 2514664 | 2/2006 |
| CH | 450688 | 1/1968 |

(Continued)

OTHER PUBLICATIONS

Computer Translation of CH 450688 (Durst) (Jan. 31, 1968).
Derwent, Abstract CN 108316581 (2018).

*Primary Examiner* — Brian D Mattei
*Assistant Examiner* — Charissa Ahmad
(74) *Attorney, Agent, or Firm* — Ulmer & Berne LLP; Brian E Turung

(57) ABSTRACT

A stair tread cover suitable for covering at least one step in a staircase. The stair tread cover includes at least a front portion and a back portion. The front and back portion each have a top surface and a bottom surface. At least one friction region is optionally positioned on the bottom surface of the front portion of the stair tread cover, and at least one gripping region is optionally positioned on the top surface of the front portion of the stair tread cover.

25 Claims, 18 Drawing Sheets

(56) References Cited

U.S. PATENT DOCUMENTS 3,669,817 A 6/1972 McDevitt
3,703,424 A 11/1972 Charnock et al.
3,895,981 A 7/1975 Tesch
4,060,947 A * 12/1977 Naka ..... E04F 11/166 52/179
4,137,356 A 1/1979 Shoemaker
4,783,939 A 11/1988 Bergmann et al.
4,840,824 A 6/1989 Davis
4,985,095 A 1/1991 Riddle
4,998,391 A 3/1991 Connew
5,051,289 A 9/1991 Riddle
5,236,753 A 8/1993 Gaggero
5,584,149 A * 12/1996 Wilson ..... A47G 27/0462 52/287.1
5,645,912 A 7/1997 Nelson et al.
D389,588 S 1/1998 Dunk
5,794,391 A 8/1998 Howard
5,799,448 A 9/1998 Dunk
5,817,399 A 10/1998 Kalman
6,318,033 B1 11/2001 Birch et al.
6,640,501 B1 11/2003 Hussey
7,073,297 B2 6/2006 Grinstead
7,493,736 B2 2/2009 Sanders
D595,079 S 6/2009 Preda
7,823,332 B2 11/2010 Siegel
8,334,041 B2 12/2012 Sweeney et al.
9,091,073 B2 7/2015 Wells
9,121,186 B2 9/2015 Mensah
9,365,385 B2 6/2016 Muxlow
D784,048 S 4/2017 Ellingson
9,714,513 B2 7/2017 Hamp
9,956,568 B2 5/2018 O'Brien
10,011,368 B1 7/2018 Parks
2002/0071924 A1* 6/2002 Lopez-Valverde ..... A47G 27/0206 428/40.1
2003/0041534 A1* 3/2003 Trpkovski ..... E06B 9/24 52/105
2003/0122053 A1* 7/2003 Sanders ..... E04G 21/30 249/207
2004/0213937 A1 10/2004 Arthur
2005/0210775 A1* 9/2005 Grinstead ..... E04F 11/1045 52/182
2006/0280891 A1* 12/2006 Swannell ..... B65D 71/0096 428/40.1
2008/0020166 A1 1/2008 Esposito
2010/0154943 A1 6/2010 Langer
2010/0251627 A1* 10/2010 Kay ..... E04F 11/166 52/28
2011/0135869 A1* 6/2011 Sweeney ..... B32B 21/10 428/77
2011/0189423 A1* 8/2011 Townsend ..... B32B 7/06 428/58
2013/0061543 A1* 3/2013 Council ..... E04F 11/175 52/179
2013/0236676 A1 9/2013 Doyle
2014/0157712 A1* 6/2014 Wells ..... E04G 21/30 52/796.1
2014/0318047 A1* 10/2014 Mensah ..... E04F 11/17 29/428
2014/0325934 A1 11/2014 Eversley et al.
2016/0312484 A1 10/2016 Ruzhin
2017/0183883 A1 6/2017 Rus
2018/0237215 A1 12/2018 Rus
2018/0347205 A1 12/2018 Rus
2018/0347216 A1 12/2018 Rus
2019/0085565 A1 3/2019 Prest

FOREIGN PATENT DOCUMENTS

CN 201310156 Y * 9/2009
CN 203320905 12/2013
DE 2432353 1/1975
DE 2418722 4/1975
DE 102016122906 5/2018
EP 0011468 5/1980
EP 535679 4/1993
JP 2010229634 A * 10/2010
WO 2003020439 3/2003
WO 2011146342 11/2011

* cited by examiner

STAIR TREAD COVER

CROSS REFERENCE TO RELATED APPLICATIONS

This application is divisional application of U.S. application Ser. No. 16/100,720 filed Aug. 10, 2018, which in turn is a continuation in part of U.S. application Ser. No. 15/995,435 filed Jun. 1, 2018, which in turn claims priority to U.S. Provisional Application Nos. 62/513,682, filed Jun. 1, 2017, the disclosures of which are herein incorporated by reference in its entirety.

BACKGROUND

The present invention relates generally to protective coverings, and more particularly to a stair tread cover for protecting stairs and other surfaces during construction, moving, painting, or other activities, and a method of manufacturing the stair tread cover.

The process of building out an area or constructing a building occurs in many phases. During this process, a number of different types of workers are required to complete the construction in stages. As a result, contractors frequently damage stairs, floors, countertops, and other finished work in the process of completing other tasks and moving heavy equipment in and out.

During the last stages of house or building construction, and after the floor and edging materials already have been installed, finish work such as painting, caulking, finish carpentry, and appliance and lighting fixture installation is typically done. This finish work can often cause significant damage to plastic laminates, linoleum, hardwood, ceramic tiles, and carpets before the building is finished, sold, or moved into. Heavy tools, caulking and paint buckets, and appliance edges are particularly damaging, especially when moved up or down stairs.

Traditionally, the only protection, if any, given to floors and/or steps during the final stages of construction has been a thin fabric drop cloth or a thin plastic sheet such as the 0.002-inch-thick self-adhesive plastic sheet. These materials help protect against minimal paint or caulking splatters and soil on workers' feet; however, such materials do not protect against more severe gouges, scrapes, abrasion, or other damage and breakage due to the impact of objects or moving of equipment/tools. Additionally, fabric throw rugs or moving van-style blankets can be used, but these absorb liquids, snag and catch on appliances, and do not protect against sharp and forceful impact. Also, these covers are bulky and heavy to transport and store and can move or slip on a stair surface, thus potentially creating problems during use.

During construction, painting or other activities, it is often desirable to protect stairs by using surface protectors. However, in instances where a drop cloth or plastic sheet becomes unusable such as, for example, from tearing or from shifting off of or away from the desired stair area, the drop cloth or plastic sheet must be removed, replaced or repositioned, costing the contractor(s) time.

In many cases, especially when construction involves walking or carrying equipment or supplies up and down steps, drop cloths or plastic sheets are not always sufficient in protecting the stairs, particularly when the stairs are finished or carpeted. For example, the size and shape of most drop cloths are often larger than the area to be covered, and are therefore also difficult to clean. Additionally, the removal of drop cloths or plastic sheets often results in the unintentional spreading of dirt, debris or paint back onto the stair surfaces that the covering was designed to protect.

Furthermore, drop cloths are not only bulky and difficult to install, but are also prone to folding, slipping on the stair surface, creasing or bunching, and forming a tripping hazard to contractors.

Non-limiting examples of existing prior art protective surface covers are described in U.S. Pat. No. 6,640,501, and United States Patent Application Nos. US 2008/0066389 and US 2011/0135869, which are incorporated herein.

In view of the current state of protective coverings, there is a need for a protective covering which is adaptable to stairs, easy to use, protects a stair surface against sharp and forceful impact, protects the exposed edges of stairs, and which can be easily and conveniently fitted to existing and/or future stairs such that the stairs can still be used while covered with the protective covering.

BRIEF DESCRIPTION

The present invention relates to a stair tread cover for protecting stairs and other surfaces during construction, moving, painting, or other activities, and a method of manufacturing the stair tread cover. A stair tread cover is generally configured to at least partially cover at least one step in a staircase. The stair tread cover of the present invention includes at least a front portion and a back portion. The front and back portion each have a top surface and a bottom surface. One or more friction regions can optionally be positioned on the bottom surface of the front portion of the stair tread cover to facilitate in maintaining the stair tread cover in position on a stair. The type of configuration of the one or more friction regions is non-limiting. The top surface of the front portion of the stair tread cover can optionally include one or more gripping regions to facilitate in providing a gripping or non-slip surface on the top surface of the front portion of the stair tread cover.

In another and/or alternative non-limiting aspect of the disclosure, the front portion of the stair tread cover is positionable on the step to protect the stair tread and the back portion is positionable on the step to protect a stair riser of the step in the staircase.

In another and/or alternative non-limiting aspect of the disclosure, the stair tread cover can include a first sheet of material that includes the front portion and a second sheet of material that includes the back portion, wherein the first and second sheets of material are connected together.

In another and/or alternative non-limiting aspect of the disclosure, the stair tread cover can include at least one reinforcement strip positioned on the top and/or bottom surface of the stair tread cover. When one or more reinforcement strip are used, such one or more strips can be secured to the top and/or bottom surface of the stair tread cover by any means (e.g., adhesive, melted seam, mechanical connection, tack, staple, snap, etc.).

In another and/or alternative non-limiting aspect of the disclosure, the front portion of the stair tread cover includes a top panel configured to protect the stair tread and a front panel configured to protect a stair nosing of the step. The back portion can include a vertical panel configured to protect a stair riser of the step.

In another and/or alternative non-limiting aspect of the disclosure, the front portion of the stair tread cover includes at least one portion of an increased thickness. The at least one portion of increased thickness can be formed from one or more layers.

In another and/or alternative non-limiting aspect of the disclosure, there can be provided a set of stair tread covers that can be suitable for covering a plurality of the steps in a staircase.

In another and/or alternative non-limiting aspect of the disclosure, the bottom surface of the front portion of the stair tread cover includes one or more friction regions. In one non-limiting configuration, the complete bottom surface of the front portion of the stair tread cover includes a friction region. In another non-limiting configuration, only a portion of the bottom surface of the front portion of the stair tread cover includes one or more friction regions. In one non-limiting specific configuration, the friction region includes at least one friction strip (e.g., adhesive strip, foam strip, rubberized strip, plastic strip, etc.) that is positioned on the bottom surface of the front portion of the stair tread cover, which one or more friction strips are used to create a removable connection or friction engagement between the bottom surface of the stair tread cover and a top surface of a stair so as to inhibit or prevent the movement of the stair tread cover on the stair when walked upon by a user. The friction region can be formed by any number of means such as, but not limited to, 1) the material that forms the front portion of the stair tread cover has an inherently tacky or high friction surface bottom surface, 2) an adhesive or tacky material or friction material (foam material, rubber material, plastic material, etc.) that is coated (e.g., spray coated, brush coated, dip coated, etc.) on all or a portion of the bottom surface of the front portion of the stair tread cover, or 3) one or more pieces of tape applied to the complete bottom surface or to a portion of the bottom surface and the side of the tape that is opposite the side that is connected to the bottom surface of the front portion has a tacky or adhesive surface or friction-forming surface. When the friction region is formed by a coating (e.g., spray coated, brush coated, dip coated, etc.), the size, shape and configuration of the one or more friction regions is non-limiting. Likewise, when the one or more friction regions are formed by one or more pieces of tape, the size, shape and configuration of the one or more friction regions is non-limiting. The thickness of the one or more friction regions is also non-limiting. Generally, the thickness of the one or more friction regions is less than 0.25 inches, and typically less than 0.1 inches. When one or more friction strips are used, such one or more strips can be secured to the bottom surface by any means (e.g., adhesive, melted seam, mechanical connection, tack, staple, snap, etc.).

In another and/or alternative non-limiting aspect of the disclosure, the top surface of the front portion of the stair tread cover includes one or more gripping regions. In one non-limiting configuration, the complete top surface of the front portion of the stair tread cover includes a gripping region. In another non-limiting configuration, only a portion of the top surface of the front portion of the stair tread cover includes one or more gripping regions. In one non-limiting specific configuration, at least gripping region is positioned on the top surface of the front portion of the stair tread cover. The gripping region can be formed by any number of means such as, but not limited to, 1) the material itself that forms the front portion of the stair tread cover has a rough or gripping top surface, adhesive surface, or tacky surface, 2) the top surface of the front portion of the stair tread cover has an embossed top surface, 3) the top surface of the front portion of the stair tread cover includes a gripping surface (e.g., rubberized surface, foam surface, plastic surface, adhesive surface, tacky surface, etc.) that is coated (e.g., spray coated, brush coated, dip coated, etc.) on all or a portion of the top surface of the front portion of the stair tread cover, or 4) one or more pieces of tape are applied to the complete top surface or to a portion of the top surface and the side of the tape that is opposite the side that is connected to the top surface of the front portion has a rough or gripping surface (e.g., rubberized surface, foam surface, plastic surface, adhesive surface, tacky surface, etc.). When the gripping region is formed by a coating (e.g., spray coated, brush coated, dip coated, etc.), the size, shape and configuration of the one or more gripping regions is non-limiting. Likewise, when the gripping region is formed by one or more pieces of tape, the size, shape and configuration of the one or more gripping regions is non-limiting. The thickness of the gripping region is also non-limiting. Generally, the thickness of the gripping region is less than 0.25 inches, and typically less than 0.1 inches. In one non-limiting specific configuration, tape is used to form the one or more gripping regions wherein the surface that is opposite the side that is connected to the top surface has a sandpaper-type texture. In another non-limiting specific configuration, the one or more gripping regions are coated (e.g., spray coated, brush coated, dip coated, etc.) on the top surface and wherein the coating includes a granular material that forms a rough surface and/or a granular material is applied to the surface of the coating to form a rough surface.

In another and/or alternative non-limiting aspect of the disclosure, the top surface of the front portion of the stair tread cover optionally includes printing (e.g., foot print design, tire tread design, cross hatch design, etc.) to provide information to a user where the user is recommended to walk on the top surface of the front portion of the stair tread cover.

In another and/or alternative non-limiting aspect of the disclosure, the top surface of the front portion of the stair tread cover optionally includes one or more recesses that are configured to receive the material that forms the gripping region (e.g., gripping tape, spray coating, brush coating, etc.). The depth of the recess is selected such that a top surface of the gripping region extends above the top surface of the front portion. When more than one recess is included in the top surface of the front portion, the recesses are generally spaced from one another.

In another and/or alternative non-limiting aspect of the disclosure, the bottom surface of the front portion of the stair tread cover optionally includes one or more recesses that are configured to receive the material that forms the friction region (e.g., adhesive tape, foam tape, rubberized sided tape, plastic tape, adhesive spray coating, foam spray coating, rubberized spray coating, plastic spray coating, adhesive brush coating, foam brush coating, rubberized brush coating, plastic brush coating, etc.). The depth of the recess is selected such that a top surface of the friction region extends above the bottom surface of the front portion. When more than one recess is included in the bottom surface of the front portion, the recesses are generally spaced from one another.

In another and/or alternative non-limiting aspect of the disclosure, there is provided a method of forming a stair tread cover suitable for at least partially covering at least one step in a staircase. The method includes: a) providing at least one sheet of material having a perimeter, and b) machine-forming the at least one sheet of material into a front portion and a back portion to form the stair tread cover.

In another and/or alternative non-limiting aspect of the disclosure, there is provided a method of: (i) positioning the front portion of the stair tread cover on a step to protect the step in the staircase, and (ii) positioning the back portion of the stair tread cover on or against the stair riser to protect the stair riser in the staircase.

In another and/or alternative non-limiting aspect of the disclosure, there is provided a method of: (a) providing a first sheet of material having a perimeter, (b) machine-forming the first sheet of material into the front portion, (c) providing a second sheet of material having a perimeter, (d) machine-forming the second sheet of material into the back portion, and (e) connecting the second sheet of material to the first sheet of material to form the stair tread cover. The front portion of the stair tread cover is positionable on the step to protect the step in the staircase and the back portion of the stair tread cover is positionable on or against the stair riser of the step to protect the stair riser of the stair in the staircase.

In another and/or alternative non-limiting aspect of the disclosure, the method of machine-forming the first sheet of material further includes the steps of: (1) scoring the first sheet of material to form at least one crease aligned generally parallel to an edge of the perimeter of the first sheet of material, and (2) folding the first sheet of material along the at least one crease to form a first panel and a second panel on either side of and foldably connected along the at least one crease.

In another and/or alternative non-limiting aspect of the disclosure, the step of machine-forming the first sheet of material further includes the step of impressing the first sheet of material to form one or more recessed zones on the top surface of the first sheet of material. Additionally, the step of machine-forming the second sheet of material can optionally further include the steps of: i) scoring the second sheet of material to form at least one crease aligned generally parallel to an edge of the perimeter of the second sheet of material; and, ii) folding the second sheet of material along the at least one crease to form a first panel and a second panel on either side of and foldably connected along the at least one crease.

In another and/or alternative non-limiting aspect of the disclosure, the method can further include the steps of: i) optionally applying one or more friction regions to a bottom surface of the front portion of the stair tread cover; and ii) optionally applying one or more gripping regions to a top surface of the front portion of the stair tread cover.

In another and/or alternative non-limiting aspect of the disclosure, there is provided a stair tread cover suitable for at least partially covering at least one step in a staircase. The step includes at least a stair tread and the stair tread cover includes a front portion comprising a first sheet of material having a perimeter, a top surface and a bottom surface; a back portion that is connected to connectable to the front portion, the back portion comprising a second sheet of material having a perimeter, a top surface and a bottom surface; at least one friction region positioned on the bottom surface of the front portion of the stair tread cover; and, optionally at least one gripping region positioned on the top surface of the front portion of the stair tread cover. The first and second sheets of material are connected to one another. In addition, at least one reinforcement strip can optionally be positioned on the top surface of the front portion of the stair tread cover.

In one non-limiting object of the present invention, there is provided a stair tread cover suitable for at least partially covering at least one step in a staircase, wherein the step includes at least a stair tread, and the stair tread cover includes a front portion and a back portion, the front and back portion each comprising a top surface and a bottom surface.

In another and/or alternative non-limiting object of the present invention, there is provided a stair tread cover that includes one or more friction regions positioned on the bottom surface of the front portion of the stair tread cover.

In another and/or alternative non-limiting object of the present invention, there is provided a stair tread cover that includes one or more gripping regions positioned on the top surface of the front portion of the stair tread cover.

In another and/or alternative non-limiting object of the present invention, there is provided a stair tread cover wherein the front portion is positionable on the step to protect the stair tread and the back portion is positionable on the step to protect a stair riser of the step in the staircase.

In another and/or alternative non-limiting object of the present invention, there is provided a stair tread cover wherein the stair tread cover comprises a first sheet of material that includes the front portion and a second sheet of material that includes the back portion, the first and second sheets of material being connected together.

In another and/or alternative non-limiting object of the present invention, there is provided a stair tread cover that includes at least one reinforcement strip positioned on the top surface of the stair tread cover.

In another and/or alternative non-limiting object of the present invention, there is provided a stair tread cover wherein the front portion comprises a top panel configured to protect the stair tread and a front panel configured to protect a stair nosing of the step.

In another and/or alternative non-limiting object of the present invention, there is provided a stair tread cover wherein the back portion comprises a vertical panel configured to protect a stair riser of the step.

In another and/or alternative non-limiting object of the present invention, there is provided a stair tread cover that includes at least one recess on the top surface of the front portion adapted to receive a gripping region.

In another and/or alternative non-limiting object of the present invention, there is provided a stair tread cover that includes at least one recess on the bottom surface of the front portion adapted to receive a friction region.

In another and/or alternative non-limiting object of the present invention, there is provided a stair tread cover wherein the front portion of the stair tread cover comprises at least one portion of an increased thickness.

In another and/or alternative non-limiting object of the present invention, there is provided a stair tread cover wherein the at least one portion of increased thickness is formed from one or more layers.

In another and/or alternative non-limiting object of the present invention, there is provided a stair tread cover that includes a first tread crease that is positioned at or between the front and back portions.

In another and/or alternative non-limiting object of the present invention, there is provided a stair tread cover that includes first and second tread creases positioned at or between the front and back portions, and wherein the first and second tread creases are position parallel to one another.

In another and/or alternative non-limiting object of the present invention, there is provided a plurality of stair tread covers suitable for covering a plurality of steps in a staircase.

In another and/or alternative non-limiting object of the present invention, there is provided a method of forming a stair tread cover suitable for at least partially covering at least one step in a staircase comprising a) providing at least one sheet of material having a perimeter, and b) machine-forming the at least one sheet of material into a front portion and a back portion.

In another and/or alternative non-limiting object of the present invention, there is provided a method that includes the further steps of: c) positioning the front portion on the step to protect the stair tread of the step in the staircase, and d) positioning the back portion on or against the stair riser to protect the stair riser of the step in the staircase.

In another and/or alternative non-limiting object of the present invention, there is provided a method that comprises providing a first sheet of material having a perimeter; machine-forming the first sheet of material into the front portion; providing a second sheet of material having a perimeter; machine-forming the second sheet of material into the back portion; and connecting the second sheet of material to the first sheet of material, and wherein the front portion is positionable on the step to protect a stair tread of the step in the staircase and the back portion is positionable on or against the stair riser to protect the stair riser of the step in the staircase.

In another and/or alternative non-limiting object of the present invention, there is provided a method of scoring the first sheet of material to form at least one crease aligned generally parallel to an edge of the perimeter of the first sheet of material, and folding the first sheet of material along the at least one crease to form a first panel and a second panel on either side of and foldably connected along the at least one crease.

In another and/or alternative non-limiting object of the present invention, there is provided a method of impressing the first sheet of material to form a recessed zone on the top surface of the first sheet of material.

In another and/or alternative non-limiting object of the present invention, there is provided a method of scoring the second sheet of material to form at least one crease aligned generally parallel to an edge of the perimeter of the second sheet of material, and folding the second sheet of material along the at least one crease to form a first panel and a second panel on either side of and foldably connected along the at least one crease.

In another and/or alternative non-limiting object of the present invention, there is provided a method of optionally applying one or more friction regions on a bottom surface of the front portion of the stair tread cover, and optionally applying one or more gripping regions to a top surface of the front portion of the stair tread cover.

In another and/or alternative non-limiting object of the present invention, there is provided a stair tread cover suitable for at least partially covering at least one step in a staircase, the step including at least a stair tread, the stair tread cover comprising a front portion comprising a first sheet of material having a perimeter, a top surface and a bottom surface; a back portion connectable to the front portion, the back portion comprising a second sheet of material having a perimeter, a top surface and a bottom surface; optionally at least one friction region positioned on the bottom surface of the front portion of the stair tread cover; and optionally at least one gripping region positioned on the top surface of the front portion of the stair tread cover, and wherein the first and second sheets of material are connected to one another.

In another and/or alternative non-limiting object of the present invention, there is provided a stair tread cover that includes at least one reinforcement strip positioned on the top surface and/or bottom of the front portion of the stair tread cover.

In another and/or alternative non-limiting object of the present invention, there is provided a method for providing temporary protection to a top surface of one or more stairs comprising the steps of (a) providing a first stair tread cover, the first stair tread cover configured to at least partially cover the first stair in a staircase, the first stair including at least a stair tread and a stair riser, the first stair tread cover includes a front portion and a back portion, the front and back portion each having a top surface and a bottom surface, the bottom surface of the front portion includes a friction region, the friction region configured to releasably maintain the position or releasably secure the bottom surface of the front portion to a top surface of the stair tread when the first stair tread cover is positioned on the stair, the friction region covering 5-100% of the bottom surface of the front portion; and, (b) placing the first stair tread cover on the stair such that i) the bottom surface of the front portion is positioned over the top surface of the stair tread and the friction region engages the top surface of the stair tread to form a temporary bond or friction engagement between the bottom surface of the front portion and the top surface of the stair tread, and ii) the bottom surface of the back portion is positioned on or adjacent to a top surface of the stair riser, and wherein a top surface of the front portion and a top surface of the back portion lie in a plane, and wherein an angle between the planes of the top surface of the front portion and the top surface of the back portion is 60-120° after the first stair tread cover is temporarily secured to the stair.

In another and/or alternative non-limiting object of the present invention, there is provided a method wherein at least one of the friction regions on the bottom surface of the front portion of the first stair tread cover is a pre-applied.

In another and/or alternative non-limiting object of the present invention, there is provided a method wherein at least one of the friction regions on the bottom surface of the front portion of the first stair tread cover is a pre-applied and includes a removable protective release liner that covers a top surface of the friction region, and further includes the step of removing the removable protective release liner from the friction region to expose the top surface of the friction region prior to placing the first stair tread cover on the stair.

In another and/or alternative non-limiting object of the present invention, there is provided a method wherein a first tread crease is positioned between the front and back portions, and further including the step of bending the front and back portions relative to one another about the first tread crease such that the angle between the planes of the top surface of the front portion and the plane of the top surface of the back portion is 60-120°.

In another and/or alternative non-limiting object of the present invention, there is provided a method wherein first and second tread creases are positioned at or between the front and back portions, the first and second tread creases positioned parallel to one another and spaced from one another, and further includes the step of bending the front and back portions relative to one another about the first tread crease or the second tread crease such that the angle between the planes of the top surface of the front portion and the plane of the top surface of the back portion is 60-120°.

In another and/or alternative non-limiting object of the present invention, there is provided a method wherein a front tread crease is positioned on the front portion, the front tread crease positioned closer to a front edge of the front portion than to a rear edge of the front portion, the front tread crease and the first tread crease positioned parallel to one another and spaced from one another, and further including the step of bending the front portion about the front tread crease to form first and second panels such that the angle between planes of a top surface of the first and second panels is 60-120°, a length of the first panel is greater than a length of the second panel, and wherein the second panel is configured to overlie and protect a nose of the stair when the tread stair cover is temporarily positioned on the stair.

In another and/or alternative non-limiting object of the present invention, there is provided a method of providing a second stair tread cover, the first and second stair tread covers having the same configuration, and further including the step of placing the second stair tread cover on a second stair such that i) the bottom surface of the front portion is positioned over the top surface of the stair tread of the second stair and the friction region engages the top surface of the stair tread of the second stair to form a temporary bond or friction engagement between the bottom surface of the front portion and the top surface of the stair tread, and ii) the bottom surface of the back portion is positioned on or adjacent to a top surface of the stair riser of the second stair, and wherein a top surface of the front portion and a top surface of the back portion lie in a plane, and wherein an angle between the planes of the top surface of the front portion and the plane of the top surface of the back portion is 60-120° after the first stair tread cover is temporarily positioned on the second stair, and wherein at least a portion of the back portion of the second stair tread cover overlies at least a portion of the second panel of the first stair tread cover.

In another and/or alternative non-limiting object of the present invention, there is provided a method wherein at least a portion of the back portion of the second stair tread cover is connected to at least a portion of the second panel of the first stair tread cover.

In another and/or alternative non-limiting object of the present invention, there is provided a method wherein at least a portion of the back portion of the second stair tread cover is connected to at least a portion of the second panel of the first stair tread cover by one or more means selected from the group consisting of adhesive, tape, snaps, melted seam, hook and loop fastener, mechanical fastener, magnet, and compression fit connection.

In another and/or alternative non-limiting object of the present invention, there is provided a method wherein a top surface of the front portion includes a pre-applied gripping region, the gripping region configured to provide a gripping surface to a user walking on the top surface of the front portion when the first stair tread cover is temporarily secured to the stair, the gripping region cover 5-100% of the top surface of the front portion.

In another and/or alternative non-limiting object of the present invention, there is provided a method wherein a portion of the pre-applied gripping region is positioned above at least a portion of the friction region.

In another and/or alternative non-limiting object of the present invention, there is provided a method wherein a top surface of the front portion includes a pre-applied printed region, the printed covering 5-100% of the top surface of the front portion, the printed region is positioned above at least a portion of the friction region.

These and other objects and advantages will become apparent to those skilled in the art upon reading and following the description taken together with the accompanying drawings.

BRIEF DESCRIPTION OF THE DRAWINGS

Reference may now be made to the drawings which illustrate various non-limiting embodiments that the disclosure may take in physical form and in certain parts and arrangement of parts wherein.

DETAILED DESCRIPTION OF NON-LIMITING EMBODIMENTS

Figure 1:
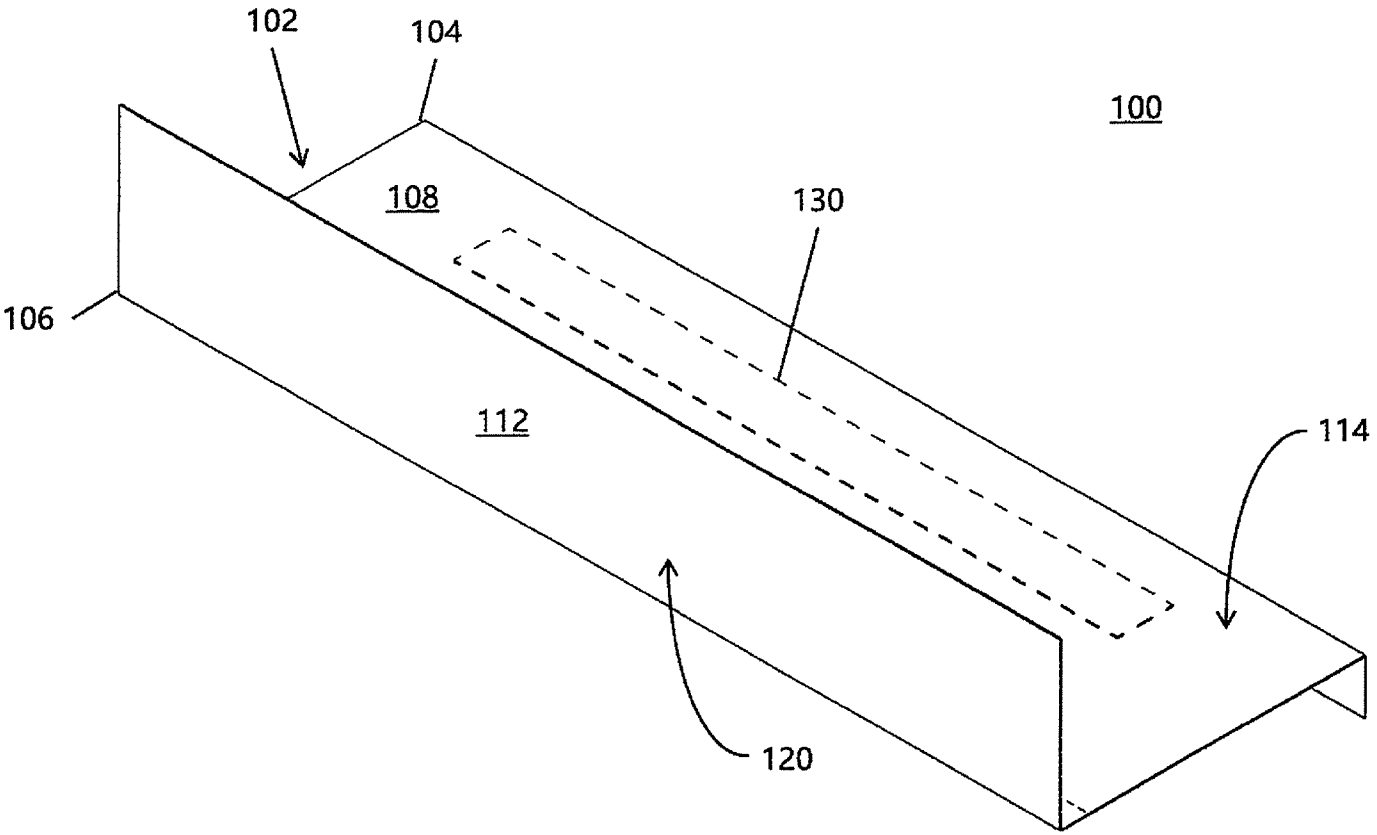
FIG. 1 is an illustration according to one non-limiting embodiment of the present invention showing a perspective view of an exemplary stair tread cover made from a single piece of material.

Referring now to the drawings, wherein the showings are for the purpose of illustrating various non-limiting embodiments of the disclosure only and not for the purpose of limiting the same, the present invention provides a system and method for surface protection comprising a stair tread cover that provides protection to stairs and/or stair surfaces.

Referring now to FIGS. 1-18, the present invention is directed to a stair or step cover suitable for at least partially covering at least one step in a staircase. In traditional staircases, each step in the staircase may include a stair tread (i.e., a top and/or horizontal surface of the step) and a stair riser (i.e., a vertical face of the step). Furthermore, each step in the staircase may include a stair nosing (i.e., an edge of the stair tread extending beyond the front face of a stair riser).

In one non-limiting aspect of the present invention, there is provided a stair tread cover 100 comprising one or more body portions 102 including a front portion 104 and a back portion 106. The front and back portions of the stair tread cover can be formed of a single piece of material, as shown in the stair tread cover embodiment 100 illustrated in FIGS. 1-8, or formed from separate pieces of material, as shown in the stair tread cover embodiments 200, 300 illustrated in FIGS. 9-16. Additionally, in such embodiments where separate pieces of material are used, the front and back portions of the stair tread cover can be permanently connected together (e.g., adhesive, melted seam, etc.) or be releasably connected together during use (e.g., hook and loop fastener, snaps, etc.). The length and width of the front and back portions are non-limiting. Generally, the length of the front and back portions is about 3-14 inches (and all values and ranges therebetween) and typically 5-10 inches, and the width of the front and back portions is about 1-6 feet (and all values and ranges therebetween), and typically 2-4 feet. In one non-limiting configuration, the width of the front and back portions is the same and the length of the front portion is greater than the length of the back portion. The front and back portions are configured such that the plane of the top surface of the front portion and the plane of the top surface of the back portion are oriented at an angle of 60-120° prior to the stair tread cover being temporarily secured to the stair, and typically substantially perpendicular (e.g., 85-95°); however, other angles can be used. The thickness of the front and back portions is non-limiting, and is generally 0.05-0.5 inches (and all values and ranges therebetween), and typically about 0.1-0.3 inches.

In one non-limiting configuration, the front portion 104 of the stair tread covers 100, 200, and 300 described herein are optionally configured to at least partially cover 1) the stair top surface, and/or 2) the stair nosing. In another and/or alternative non-limiting configuration, the back portion 106 of the stair tread covers 100, 200, and 300 described herein are optionally configured to at least partially cover the stair riser. In other words, the body 102 of the stair tread covers 100, 200, and 300 described herein generally includes a first panel 108 that covers a top surface of a stair tread, a second panel 110 that covers the stair nosing, and a third panel 112 that covers the stair riser. In another and/or alternative non-limiting configuration, the front and/or back portions 104, 106 of the stair tread covers 100, 200, and 300 described herein can be sized larger than the stair tread and/or stair riser, respectively, so as to also cover any unprotected part of the adjacent stair riser and/or tread. As such, the presently described stair tread covers 100, 200, and 300 may optionally be configured to cover two, three, or more steps in a staircase.

The material used to form the stair tread cover is non-limiting (e.g., paper board, cardboard, plastic, etc.). The stair tread cover can be formed from one, two, or more different materials. In one non-limiting configuration, the front portion 104 the stair tread covers 200 and 300 of the present invention is formed from a first sheet of material having a perimeter and the second portion 106 is formed from a second sheet of material having a perimeter.

In another and/or alternative non-limiting configuration, the material used to form the presently described stair tread covers 100, 200, and 300 can be formed from water-resistant and/or liquid-proof materials. As such, in the instance a fluid (e.g., water, paint, etc.) is spilled on the stair tread cover, the material of the stair tread cover is sufficiently thick and/or sufficiently fluid-impermeable so as to inhibit or prevent the spilled fluid from seeping therethrough and contacting the stairs. In one specific non-limiting configuration, exemplary stair tread covers 100, 200, and 300 can include the use of fiberboard. In another and/or alternative specific non-limiting configuration, presently described stair tread covers 100, 200, and 300 can include the use of paper pulp-based material. In yet another and/or alternative specific non-limiting configuration, exemplary stair tread covers 100, 200, and 300 can include the use of press board material. As defined herein, fiberboard is a type of engineered wood product that is made out of wood fibers. The general types of fiberboard (in order of increasing density) include particle board, medium-density fiberboard, and hardboard. Plywood is not a type of fiberboard, as it is made of thin sheets of wood, not wood fibers or particles. Cardboard is also not fiberboard since it includes a corrugated layer.

In another and/or alternative non-limiting aspect of the present invention, the front portion 104 of the stair tread covers 100, 200, and 300 includes a first crease 122. In one non-limiting configuration, the front portion 104 of the stair tread cover is folded along the first crease 122 so as to provide the first panel 108 and the second panel 110 on either side of the first crease. In one specific non-limiting configuration, the front portion 104 of the stair tread covers 100, 200, and 300 is folded along the first crease 122 such that the first panel 108 is about 60-120°, and typically substantially perpendicular (e.g., 85-95°) to the second panel 110; however, other angles can be used. As such, the second panel 110 of the front portion 104 of the stair tread covers 100, 200, and 300 can optionally be bent, folded and/or shaped around a stair nosing. The front portion 104 of the stair tread covers 100, 200, and 300 can optionally be manufactured as a pre-formed component. The type of machine and/or technique used to pre-form (when used) the front portion of the stair tread cover is non-limiting. For example, the front portion of the stair tread cover can optionally be formed via thermo-fitting. The size and shape of the second panel is non-limiting. In one non-limiting configuration, the second panel 110 (i.e., the panel which protects the stair nosing) is about 0.5-6 inches in length (and all values and ranges therebetween). In one non-limiting configuration, the width of the first and second panels is the same and the length of the first panel is greater than the length of the second panel. The thickness of the first and second panels can be the same or different.

In another and/or alternative non-limiting aspect of the present invention, the front portion 104 of the stair tread covers 100, 200, and 300 optionally includes one or more areas 124 for at least one friction region 126. The area 124 for the at least one friction region 126 is located on a bottom surface 116 of the front portion 104 of the stair tread covers 100, 200, and 300. The area 124 for the at least one friction region can be recessed; however, this is not required. If area 124 is recessed, the recess is generally less than the thickness of the friction region that is positioned in the recess so that the top surface of the friction region extends above the top plane of the bottom surface of the front portion.

Figure 6:
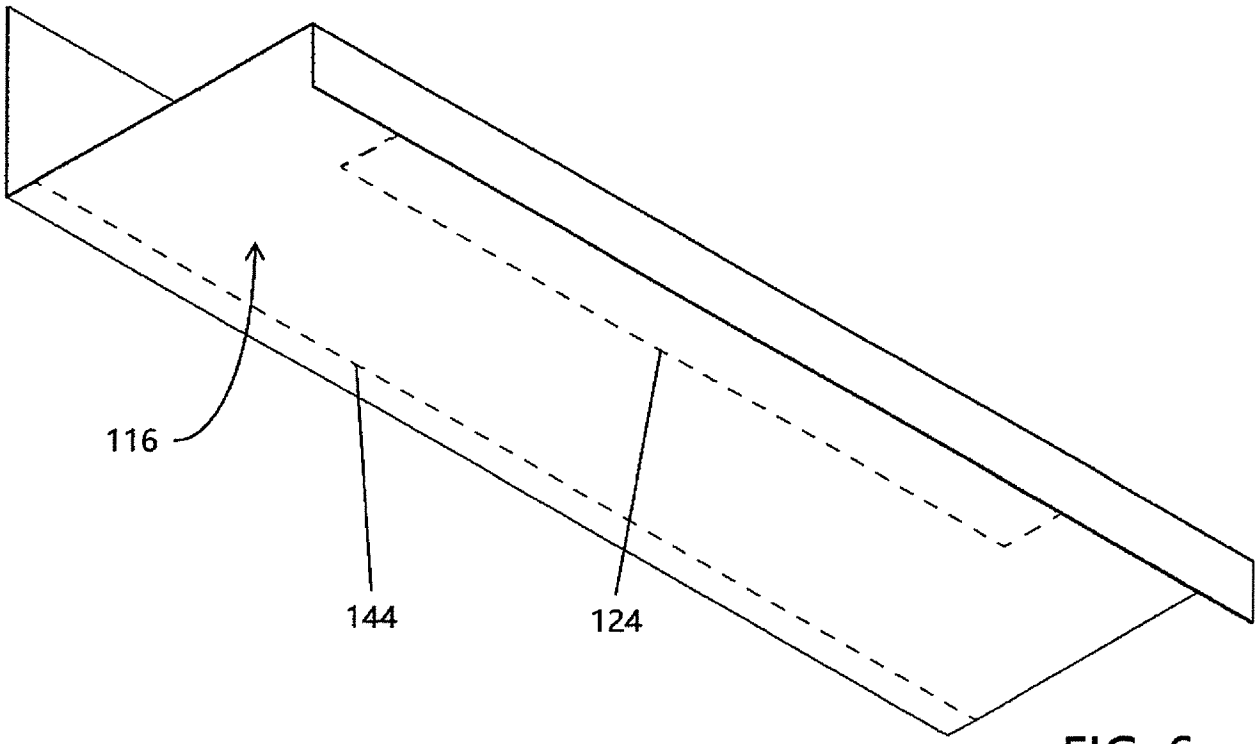
FIG. 6 is an illustration showing additional features of the stair tread cover of FIG. 1 in accordance with the present invention.

Area 124 is illustrated as being spaced inwardly from the front edge of the front portion or spaced inwardly from first crease 122; however, this is not required. The two side edges of area 124 are illustrated as being both spaced from the side edges of the front portion; however, this is not required. The size of area 124 generally constitutes at least 5% of the surface area of the bottom surface of the front portion, and can cover up to 100% of the surface area of the bottom surface of the front portion. As illustrated in FIG. 6, area 124 is located on the bottom surface of the first panel of the front portion; however, if can be appreciated that a second area 124 can be located on the bottom surface of the second panel of the front portion. As illustrated in FIG. 6, area 124 constitutes about 5-30% of the bottom surface of the first panel and is spaced closer to first crease 122 than to second crease 142.

In one non-limiting arrangement, the friction region 126 is formed of one or more adhesive strips, foam strips, rubberized strips, plastic strips, etc. In another and/or alternative non-limiting configuration, the at least one strip is positioned on the bottom surface 116 of the front portion 104 of the stair tread covers 100, 200, and 300. As can be appreciated, a plurality of strips can be used to cover all or only a portion of the bottom surface.

In another non-limiting arrangement, the friction region 126 is formed of a coating of material (e.g., adhesive, plastic material, rubberized material, plastic material, polymer material, etc.) that has been sprayed on, brushed on, or otherwise applied to the bottom surface of the front portion.

As illustrated in FIG. 6, the friction region only covers a portion of the bottom surface. As can be appreciated, a coating can alternatively be used instead of a strip.

The at least one friction region 126 (when used) provides a temporary, non-slip contact between the top surface of a stair and the bottom surface 116 of the exemplary stair tread covers. Furthermore, the at least one friction region 126 allows the stair tread covers to be usable on various types of surfaces including, but not limited to, hardwood surfaces, laminate surfaces, carpeted surfaces, non-carpeted surfaces, concrete surfaces, composite surfaces, plastic surfaces, plywood surfaces, etc. The friction engagement optionally forms a dust-proof, dirt-proof and/or liquid-proof engagement region between the stair tread covers and the underlying stair; however, this is not required. As such, during use, dirt and/or debris can be prevented from working its way under the presently described stair tread covers and between the stair tread covers and the stair.

The friction region can be pre-applied (e.g., pre-applied strip or pre-applied spray coating or pre-applied brush coating, etc.).

The at least one friction region can optionally include a corresponding removable protective release liner 128 (FIG. 18) that, when removed, exposes a friction surface, adhesive surface, or tacky surface of the friction region. The exposed surface of the friction region is designed to form a temporary (i.e., removable) bond or friction engagement with a top surface of a stair and the stair tread cover. The temporary bond or friction engagement between the exposed friction region and the stair is designed to sufficiently hold the stair tread cover in position and prevent the stair tread cover from sliding or moving relative to the stair, while still remaining removable such that the stair tread cover can be removed from the stair before, during, or after use without damage to the stair.

Figure 14:
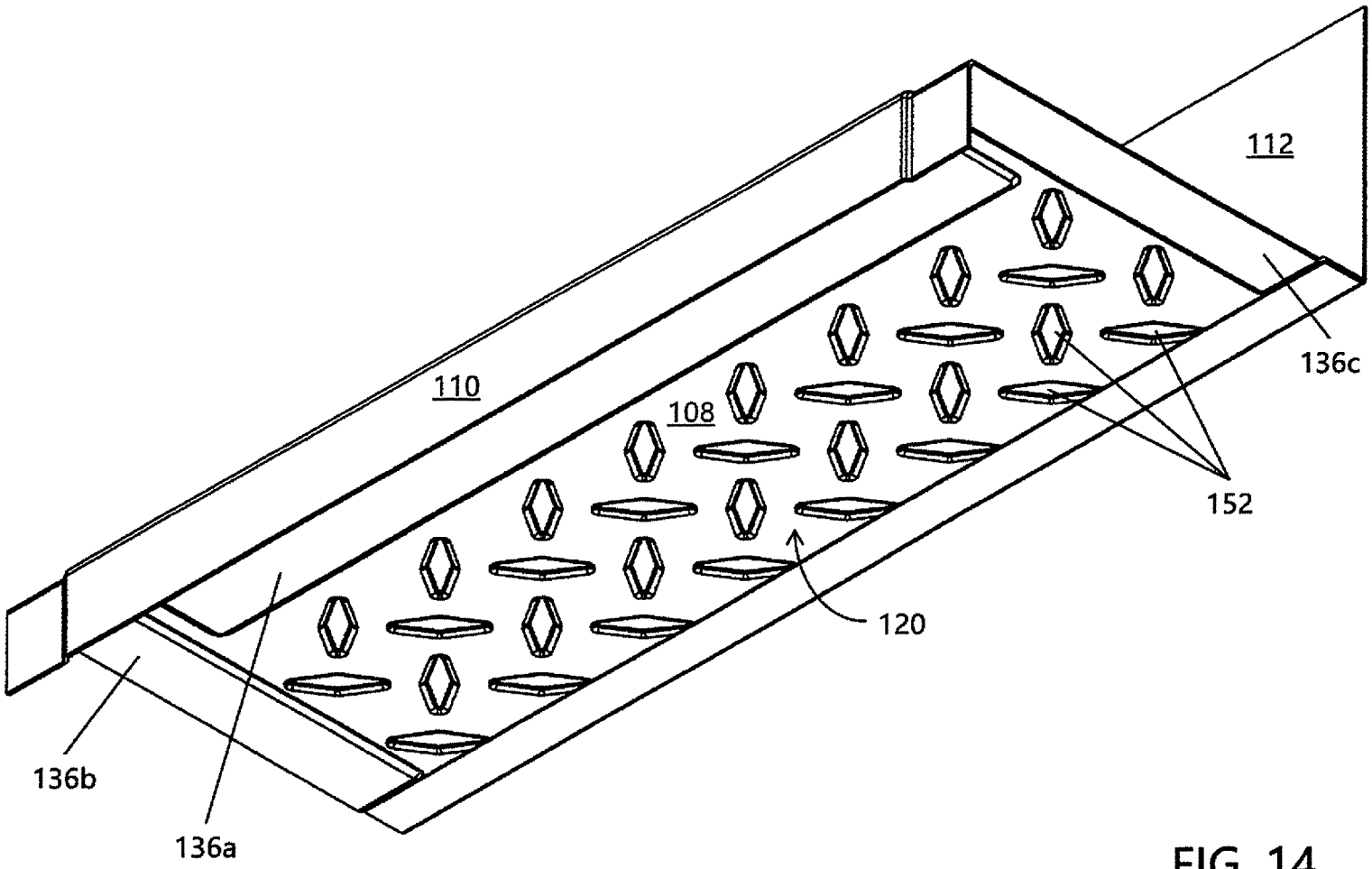
FIG. 14 is an illustration showing additional features of the stair tread cover of FIG. 13 in accordance with the present invention.
Figure 15:
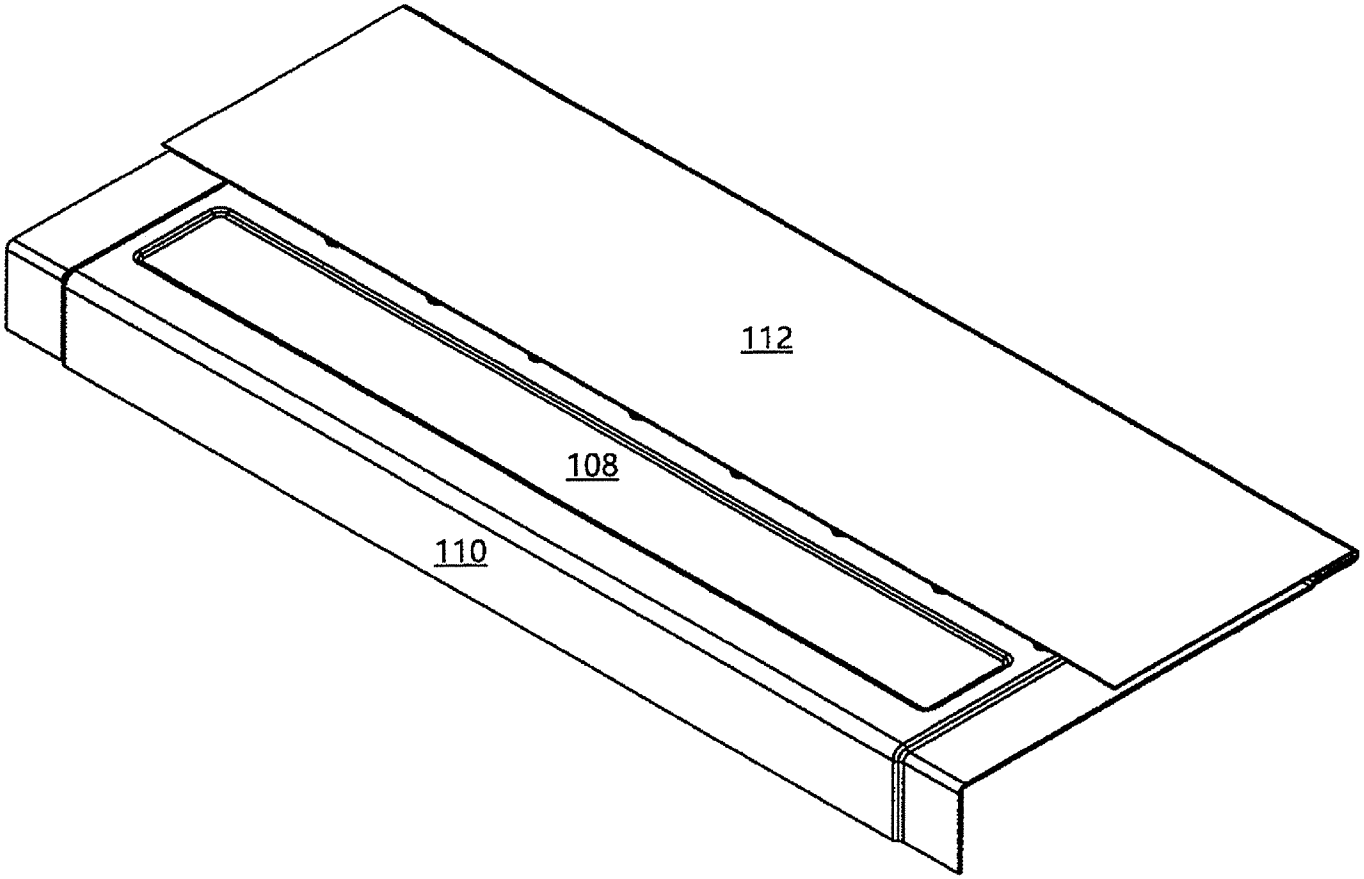
FIG. 15 is an illustration showing additional features of the stair tread cover of FIG. 13 in accordance with the present invention.
Figure 16:
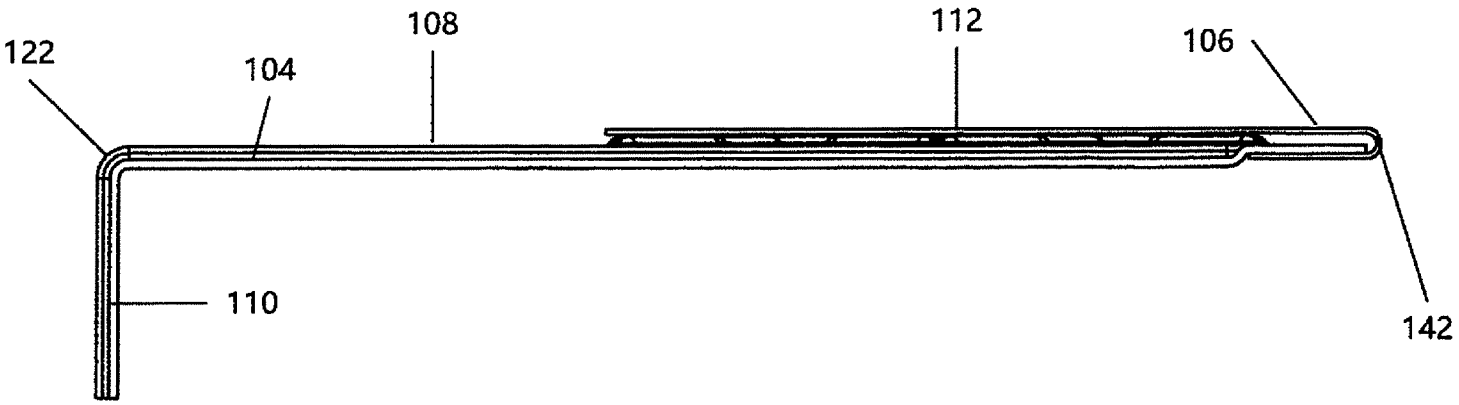
FIG. 16 is an illustration showing additional features of the stair tread cover of FIG. 13 in accordance with the present invention.

The size, shape and quantity of the at least one friction region 126 is non-limiting. Generally, the width of the friction region when in the form of a strip is 0.25-5 inches and all values and ranges therebetween (e.g., 1 inch, 2 inches, 2.5 inches, etc.). The thickness of the friction region is generally less than 0.25 inches (e.g., 0.001-0.24 inches and all values and ranges therebetween), and typically about 0.002-0.15 inches. In one non-limiting configuration, at least one friction region 126 such as a strip or spray coating is generally positioned parallel at or near the first crease 122 in the front portion 104 of the presently described stair tread covers to provide a non-slip surface at or near the step nosing (the most frequently contacted part of the step). As can be appreciated, one or more additional friction regions can be positioned adjacent to the friction region 126 of the stair tread cover. When two of more friction regions are used, such friction regions are generally spaced from one another; however, this is not required. As can also be appreciated, the stair tread cover can optionally include friction regions positioned on other surfaces (i.e., the second panel 110 of the front portion 104 of the stair tread covers, bottom surface of the back portion, etc.) to correspond to other portions of steps (e.g., stair nosing, stair riser, etc.) which may be in contact with a user or equipment. For example, as shown in FIG. 14, friction regions may be positioned parallel at or near the first crease at area **136*a* and/or perpendicular to the first crease at or near the areas 136*b*, 136*c* of the stair tread cover. In another and/or alternative non-limiting configuration, at least one friction region 126 is optionally generally positioned at or within 1-2 inches of the front of the stair tread cover. In another and/or alternative non-limiting configuration, at least one friction region 126 is optionally generally positioned at or near perimeter surfaces (e.g., areas 136*a*, 136*b*, 136*c*) (FIG. 14) of the stair tread cover. The number and orientation of the one or more friction region on the bottom surface 116 of the presently described stair tread covers 100, 200, 300** is non-limiting.

Figure 7:
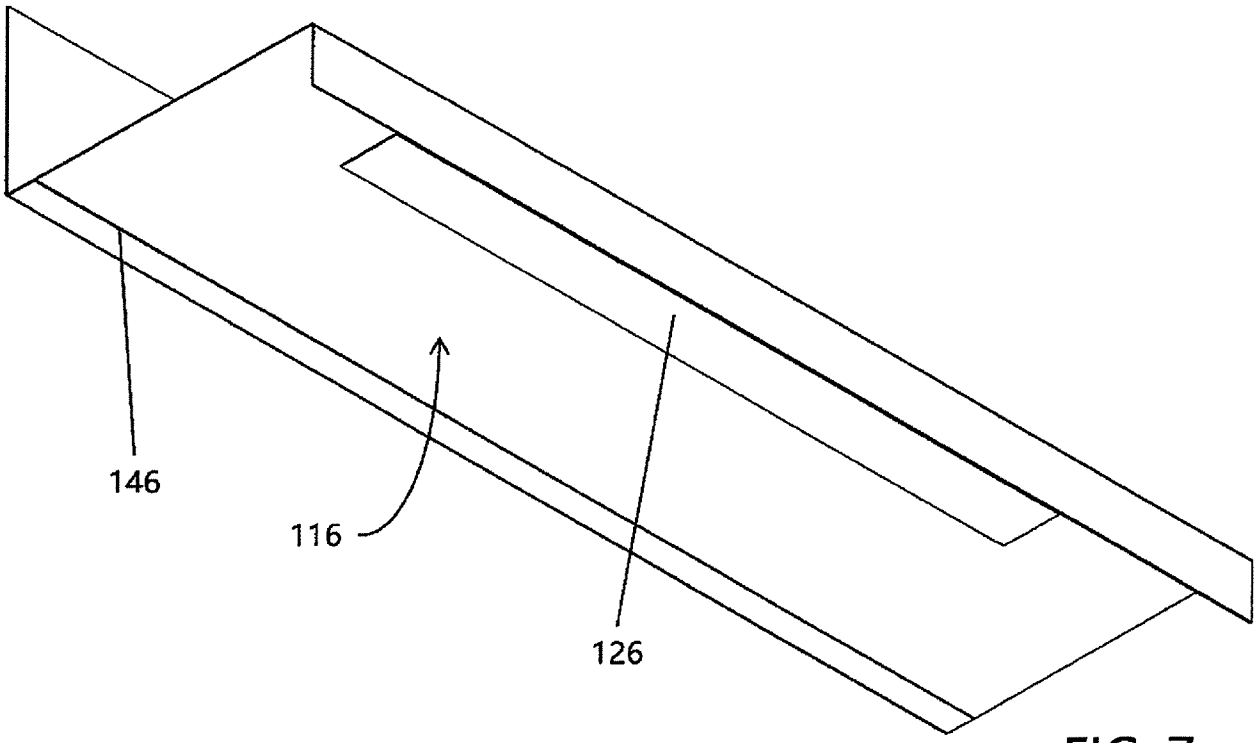
FIG. 7 is an illustration showing additional features of the stair tread cover of FIG. 1 in accordance with the present invention.

As illustrated in FIG. 7, the friction region 126 can be positioned generally parallel to the front edge of the front portion 104. The friction region 126 is also illustrated as partially the full width of the front portion 104; however, it can be appreciated that the friction region can extend the full width of the front portion. Generally, the friction region 126 is configured to extend at least 50% the width of the front portion 104, and typically extend at least 70% the width of the front portion. If more than one friction region 126 is used and positioned along the generally same plane along the width of the front portion, the total length of the plurality of friction regions are configured to extend at least 50% the width of the front portion, and typically extend at least 70% the width of the front portion. Generally, the friction region covers at least about 5% of the bottom surface area of the front portion, and can cover up to 100% of the bottom surface area of the front portion. FIG. 7 illustrates only a single friction region on the bottom surface of the first panel 108; however, it can be appreciated, that a plurality of friction regions can be included on the bottom surface of the first panel.

Figure 8A:
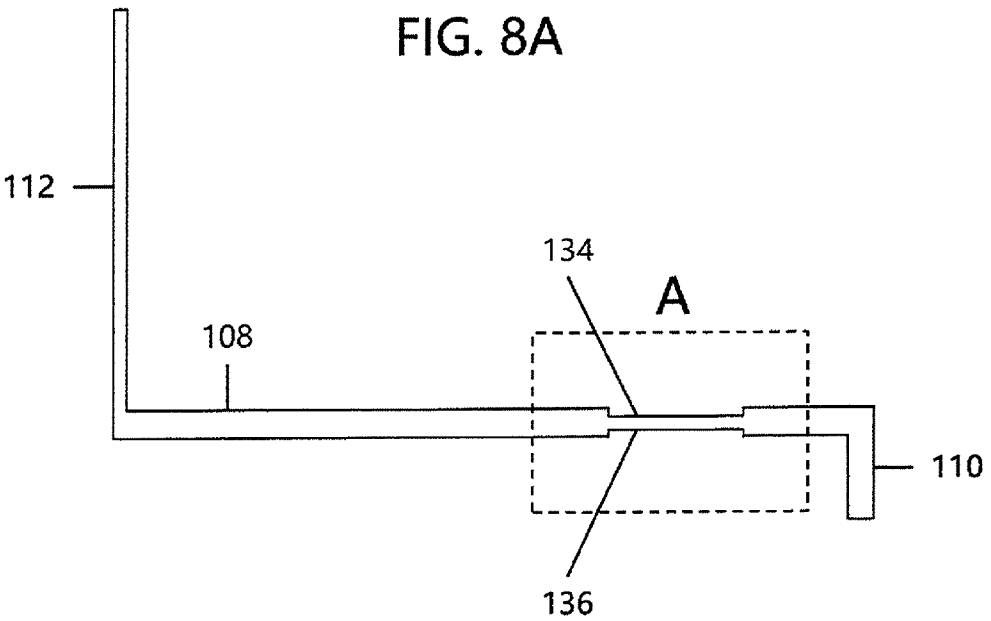
FIGS. 8A-8C illustrate additional features of the stair tread cover of FIG. 1 in accordance with the present invention.
Figure 8B:
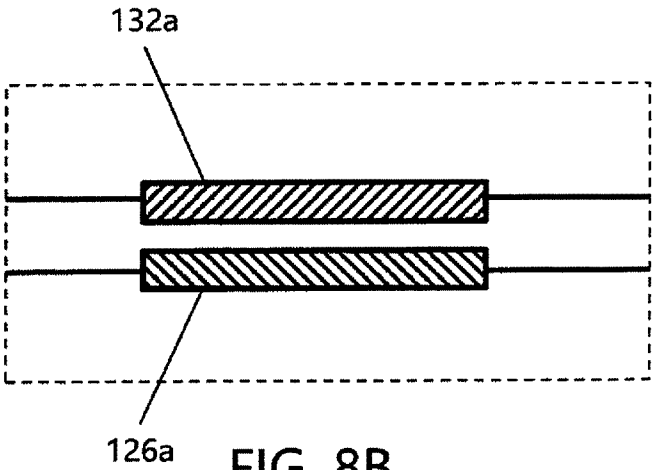
Figure 8C:
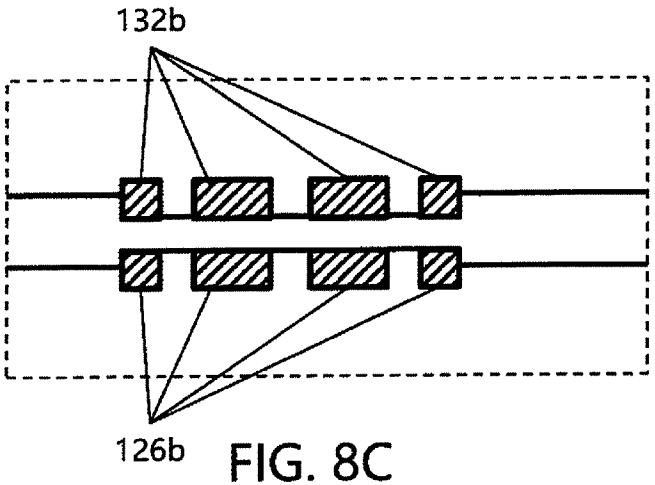
Figure 9:
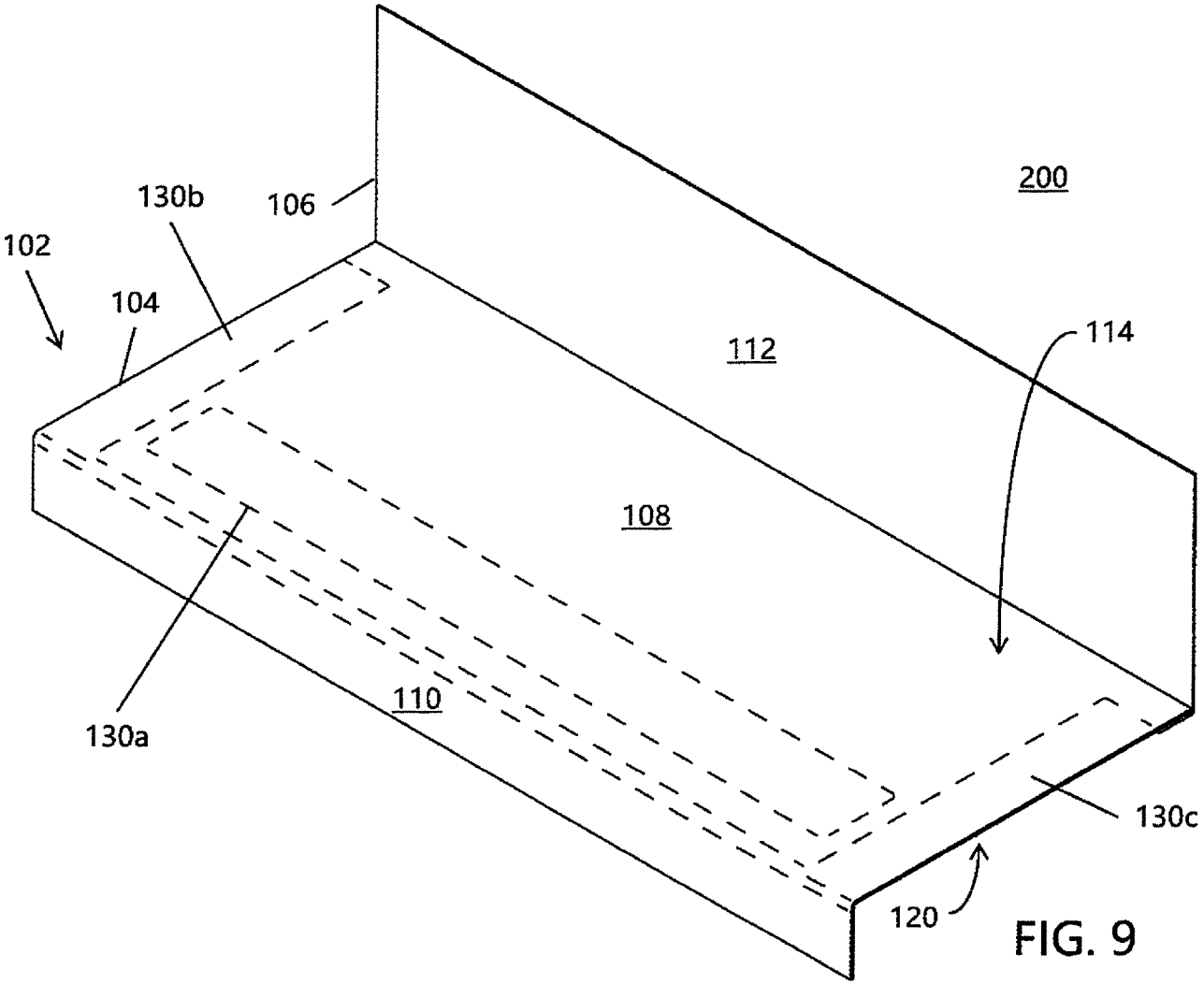
FIG. 9 is an illustration according to another non-limiting embodiment of the present invention showing a perspective view of an exemplary stair tread cover made from two or more pieces of material.
Figure 10:
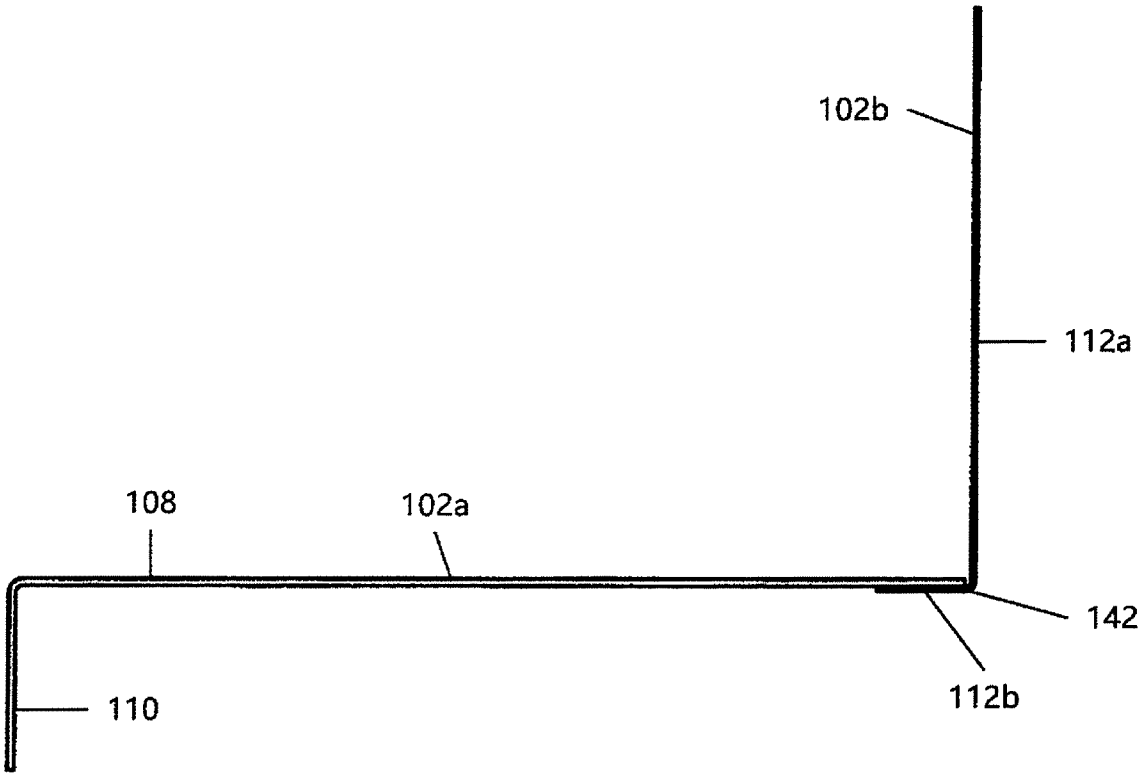
FIG. 10 is an illustration showing a side view of the stair tread cover of FIG. 9 in accordance with the present invention.
Figure 11:
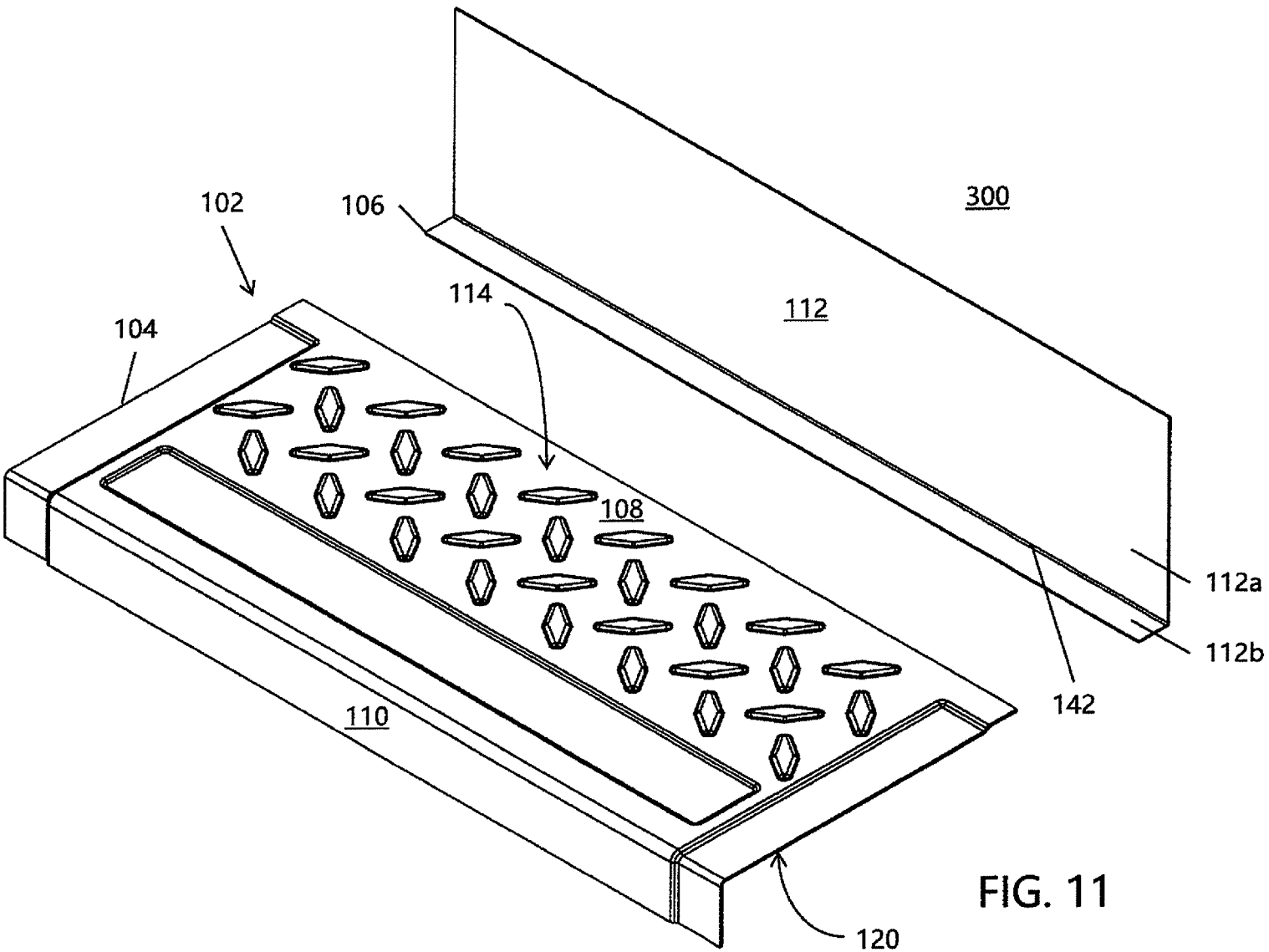
FIG. 11 is an illustration according to another non-limiting embodiment of the present invention showing a perspective view of another exemplary stair tread cover made from two or more pieces of material, where the two or more pieces of material are in a non-attached configuration.
Figure 12B:
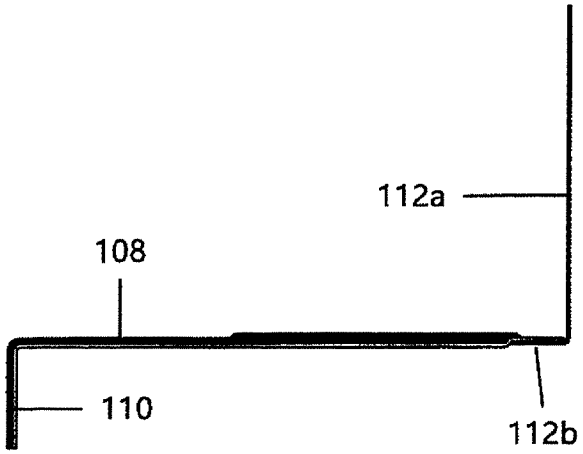
FIGS. 12A and 12B illustrate additional features of the stair tread cover of FIG. 11 in accordance with the present invention.
Figure 12A:
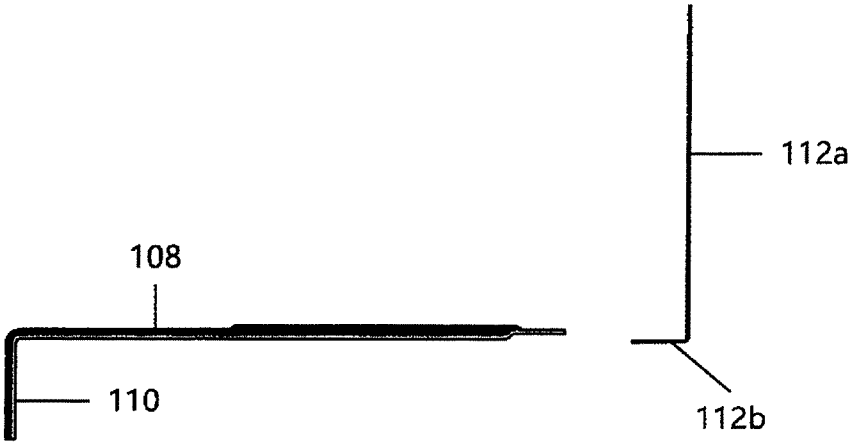

In another and/or alternative non-limiting aspect of the present invention, the front portion 104 of the stair tread covers 100, 200, 300 on a top surface 114 of the stair tread cover optionally includes one or more gripping regions 130. In one non-limiting arrangement, the gripping region can be in the form of a grip strip 132 or a grip coating. In one non-limiting configuration, the gripping region forms a sandpaper-like surface. In another and/or alternative non-limiting configuration, the at least one gripping region is in the form of a grip strip 132. In another and/or alternative non-limiting configuration, at least one gripping region 132 is positioned on the top surface 114 of the first panel 108 of the front portion 104 of the stair tread covers 100, 200, 300. Optionally, as shown in FIGS. 8A-8C, the top surface 114 of the first panel 108 of the front portion 104 can include one or more recesses 134 into which the at least one gripping region 130 may be placed. In such a configuration, the thickness of the gripping region is greater than the thickness of the recess 134 in the front portion 104 such that the top surface of the gripping region extends upwardly from the top surface 114 of the front portion.

Figure 2:
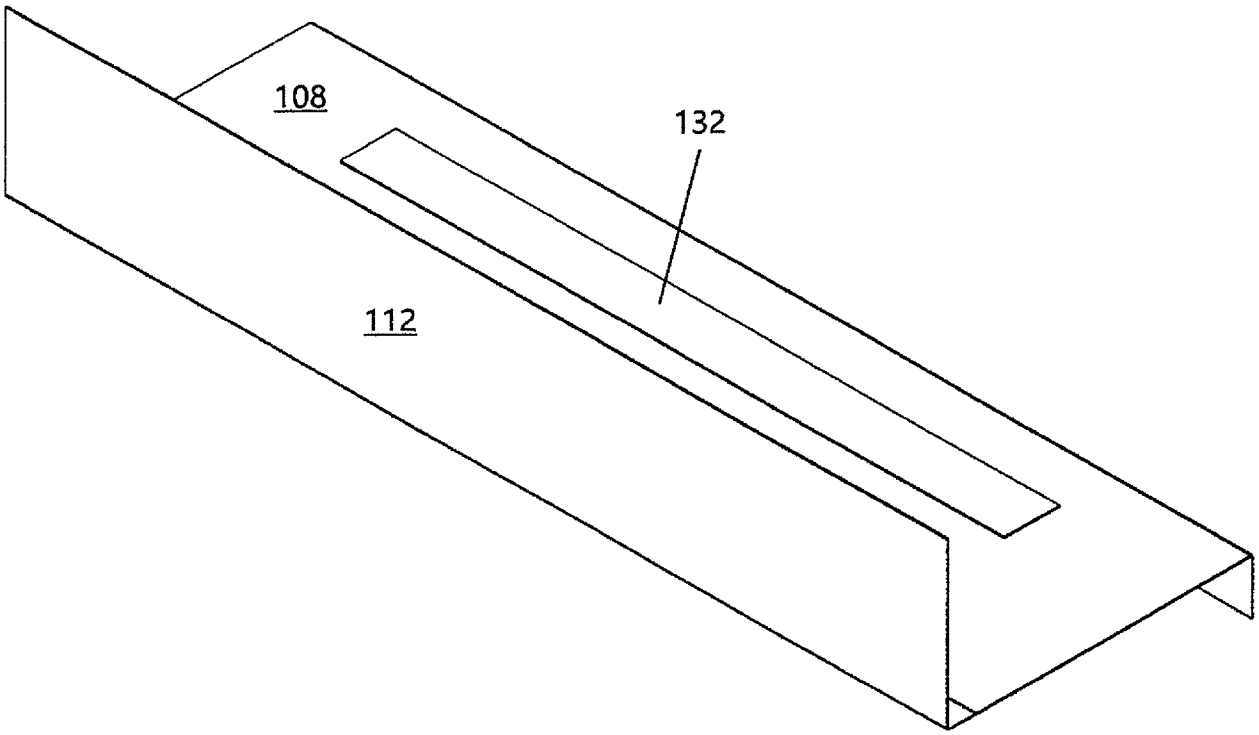
FIG. 2 is an illustration showing additional features of the stair tread cover of FIG. 1 in accordance with the present invention.
Figure 3:
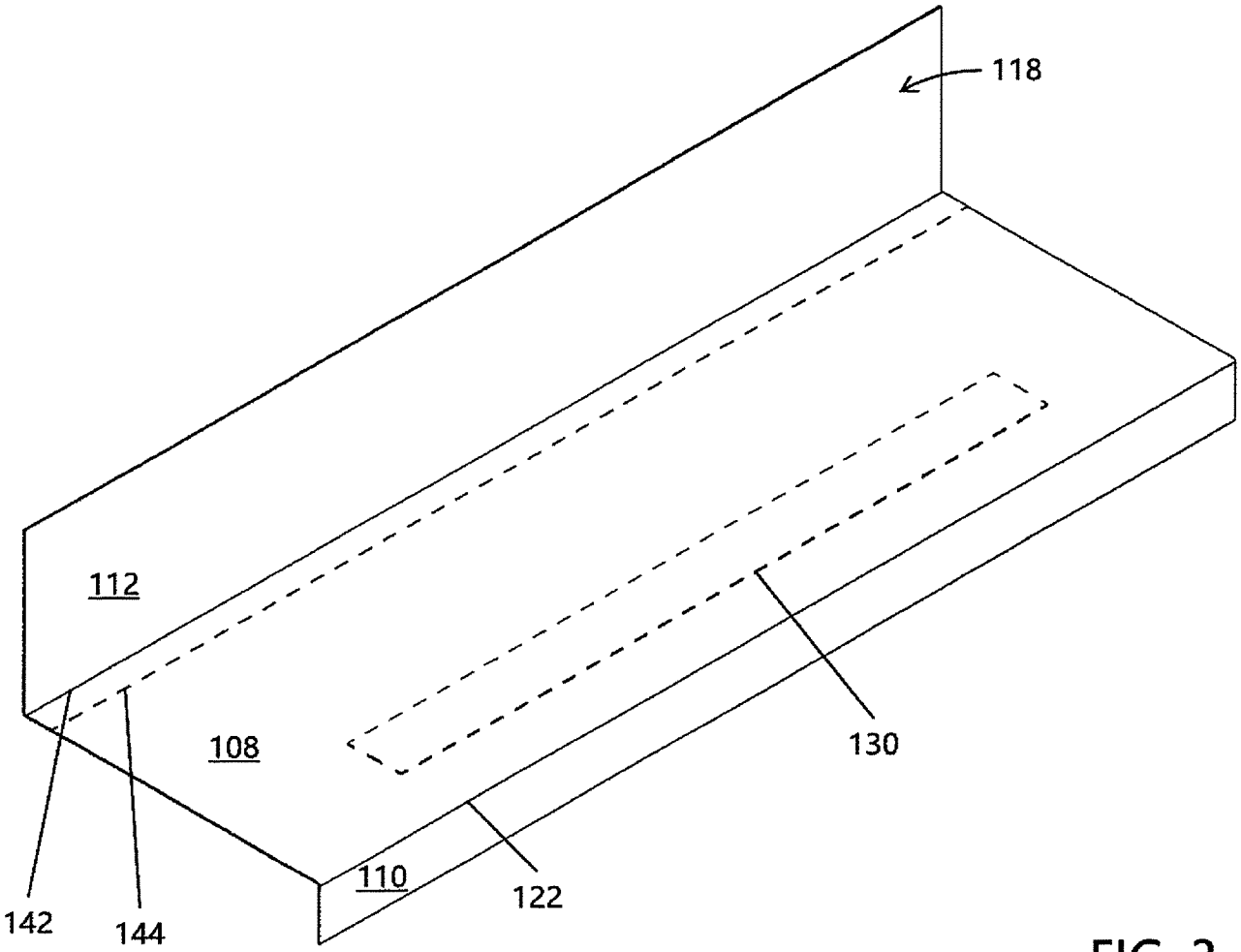
FIG. 3 is an illustration showing additional features of the stair tread cover of FIG. 1 in accordance with the present invention.
Figure 4:
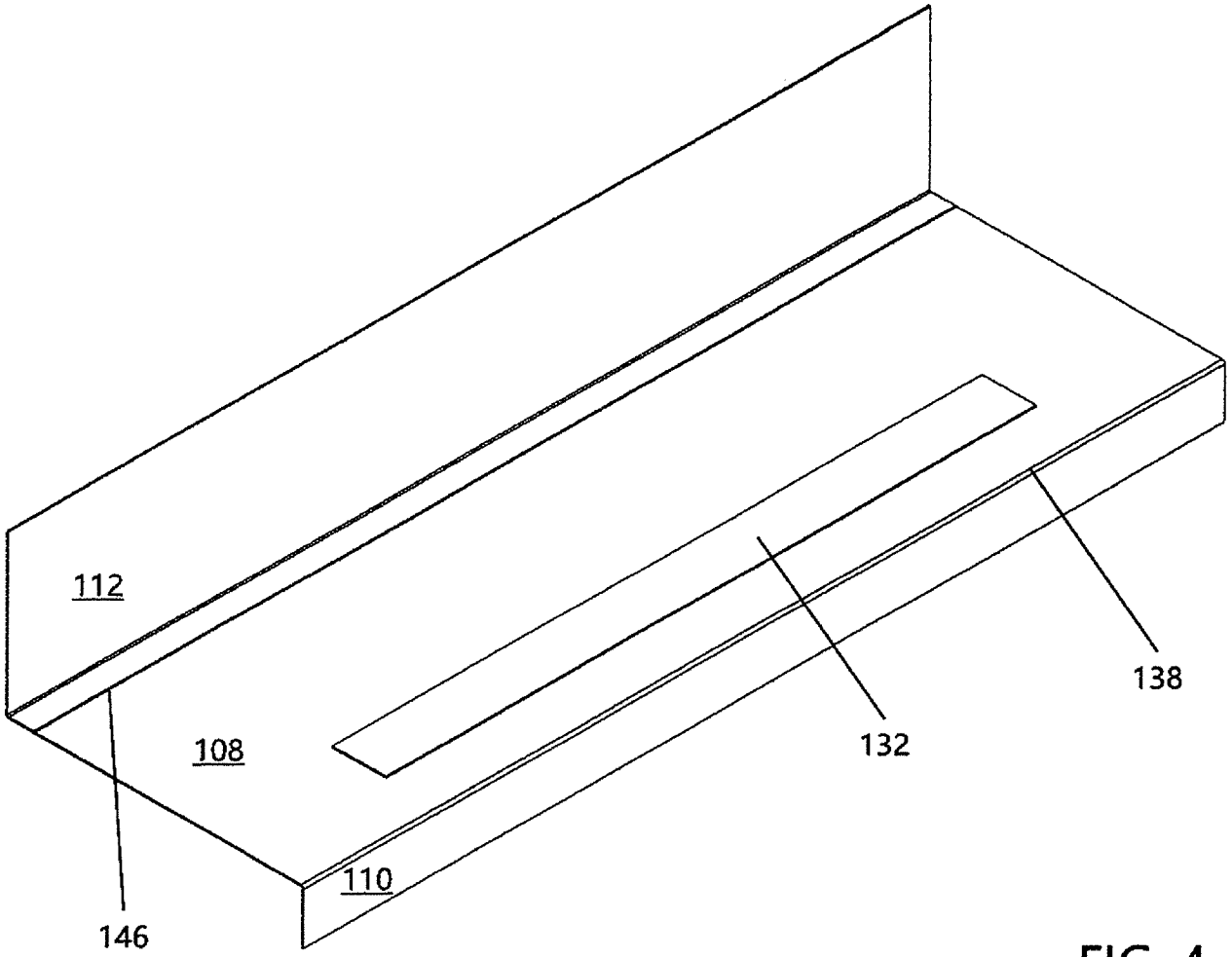
FIG. 4 is an illustration showing additional features of the stair tread cover of FIG. 1 in accordance with the present invention.
Figure 5:
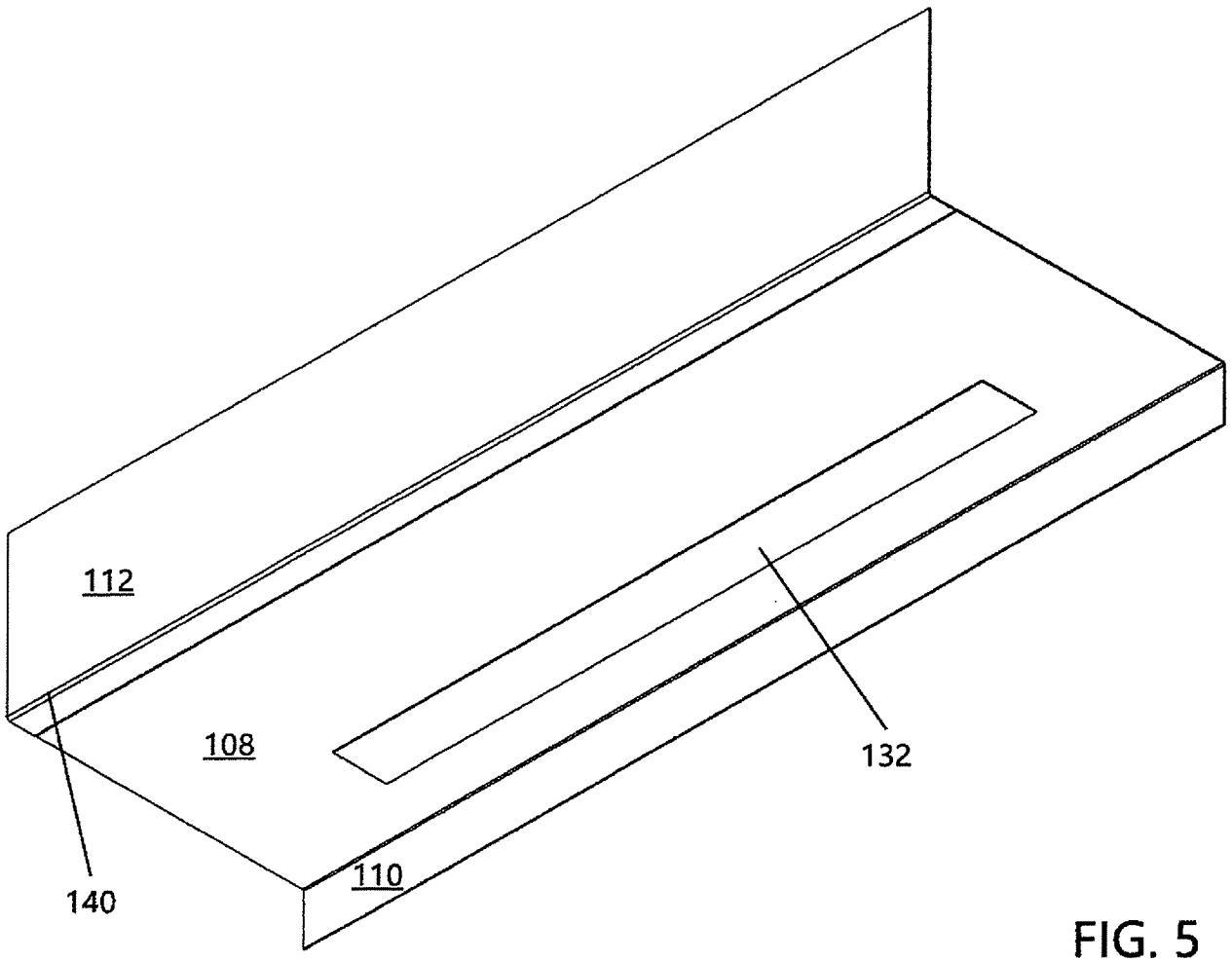
FIG. 5 is an illustration showing additional features of the stair tread cover of FIG. 1 in accordance with the present invention.

The at least one gripping region (when used) provides a non-slip contact on the top surface 114 of the stair tread covers 100, 200, 300 so as to improve the traction and/or grip between a user's shoe and the stair tread cover. As such, during use, injury as a result of a person or equipment sliding on the stair tread cover can be reduced or prevented. The at least one gripping region can be a pre-applied grip strip or pre-applied grip coating. The at least one gripping region can optionally include a removable protective release liner (not shown) that, when removed, exposes a top gripping surface of the at least one gripping region. In one specific non-limiting configuration, the at least one grip region is in the form of a pre-applied grip tape or grip spray coating that is optionally positioned in recess 134 on the top surface 114 of the front portion 104 of the exemplary stair tread covers 100, 200, 300. In another specific non-limiting configuration, as shown in FIGS. 2, 4, and 5, for example, the at least one gripping region is a formed of grip tape or sprayed grip coating that is applied to the top surface 114 of the front portion 104 of the stair tread cover 100.

The size, shape and quantity of the one or more gripping regions is non-limiting. The one or more gripping regions generally cover at least 5% of the top surface area of the front portion 104 of the stair tread cover 100 and can cover up to 100% of the top surface of the front portion 104 of the stair tread cover 100. Generally, the width of the gripping region when in the form of a grip strip is about 0.25-5 inches and all values and ranges therebetween (e.g., 1 inch, 2 inches, 2.5 inches, etc.). The thickness of the gripping region is generally less than 0.25 inches (e.g., 0.001-0.24 inches and all values and ranges therebetween), and typically 0.005-0.18 inches. In one non-limiting configuration, a first gripping region is generally positioned parallel at or near the first crease 122 in the stair tread cover to provide a non-slip surface at or near the step nosing (the most frequently contacted part of the step). As can be appreciated, one or more additional gripping regions can be positioned adjacent to the first gripping region of the stair tread cover. As can be appreciated, the stair tread cover can include additional gripping regions positioned to correspond to other portions of steps which may be in contact with a user or equipment (e.g., stair risers, stair nosing, etc.). In another and/or alternative non-limiting configuration, a gripping region is optionally generally positioned at or within 0-3 inches (and all values and ranges therebetween) of the front of the stair tread cover, and typically about 1-2 inches of the front of the stair tread cover. In another and/or alternative non-limiting configuration, a gripping region is optionally generally positioned at or near the perimeter of the stair tread cover, such as, for example, locations 134*a*, 134*b*, and 134*c* shown in FIG. 13.

In another and/or alternative non-limiting aspect of the present invention, when a first gripping region 130 and a first friction region 126 are used, the first gripping region is optionally positioned directly above or at least partially overlaps the first friction region on the front portion of the stair tread cover. In another and/or alternative non-limiting aspect of the present invention, the gripping region can be optionally provided in the recess 134 on the top surface 114 of the front portion 104 and the friction region 126 can be optionally provided in its own recess 136 directly beneath the recess for the gripping region and on the bottom surface 116 of the front portion, as shown in FIGS. 8A-8C. As also shown in FIGS. 8B-8C, which illustrate a zoomed-in view of section A from FIG. 8A, in another and/or alternative non-limiting aspect of the present invention, the gripping region and the friction region can be provided as substantially solid pieces of material 132*a*, 126*a*, respectively, as particularly shown in FIG. 8B. Alternatively, the gripping region and the friction region can be provided as one or more pieces of material 132*b*, 126*b*, respectively, as particularly shown in FIG. 8C. As such, during use, when a user walks on the gripping region on the top surface of the stair tread cover, the weight of the user reinforces/re-engages the temporary bond or friction engagement between the friction region on the bottom of the stair tread cover and the top surface of the stair tread. In prior art protective coverings which are not bonded to a surface, the protective covering tends to slide or be displaced from its original position. One non-limiting advantage of the stair tread cover of the present invention is that, over time, as users repetitively step on the gripping region, the stair tread cover is not displaced from its original position, unless physically removed from the position by a user.

As can be appreciated, a printed region can optionally be substituted for the gripping region or be used in conjunction with the gripping region. The print configuration that is used in the printed region is not limited (e.g., foot drawings, tire tread drawings, cross hatch drawing, etc.). The printed region (when used) can provide visual information to the use as to where to step or not step on the top surface of the front panel of the stair tread cover. As can be appreciated, when the printed region is substituted for the gripping region, the printed region can be located in the same location as the gripping region as illustrated in FIG. 2.

In another and/or alternative non-limiting aspect of the present invention, the stair tread cover can also include at least one reinforcement strip positioned on the top surface 114 of the stair tread cover, and/or on the bottom surface of the stair tread cover. For example, the front portion 104 of the exemplary stair tread cover 100 optionally includes a reinforcement strip 138 adapted to reinforce an area of high stress and strain. In one non-limiting configuration shown in FIG. 4, the reinforcement strip 138 can be provided at the first crease 122 of the front portion 104 of the stair tread cover. In addition, or alternatively, a reinforcement strip 140 can be provided at the second crease 142 of the back portion 106 of the stair tread cover as shown in FIG. 5. The at least one reinforcement strip 138, 140 (when used) provides a portion of stair tread cover which has significant stability and durability reinforcement. As such, during use, damage to the stair tread cover at or near the nose of the stair can be prevented. The reinforcement strip can be a pre-applied reinforcement strip. The reinforcement strip can thus be used to provide reinforcement and wear resistance to the region about first crease 122. Generally, the reinforcement strip (when used) fully overlies the first crease 122 and typically extends about 0.5-4 inches on each side of the first crease 122. As such, the reinforcement strip (when used) does not typically cover the full top or bottom surface of the stair tread covers 100, 200, and 300. The reinforcement strip (when used) generally extends 70-100% the width of the front panel 110. The reinforcement strip (when used) generally is formed of a fiber, plastic or paper material (e.g., paper tape, fiber-reinforced paper tape, plastic tape, etc.). Generally, the reinforcement strip (when used) is secured to the front panel 110 by an adhesive; however, other means can be used (e.g., melted seam, etc.). The reinforcement strip (when used) can be applied to either or both the top and bottom surfaces of the stair tread cover.

The at least one reinforcement strip 138, 140 can be used for: i) reinforcement of the stair tread cover, and/or ii) retaining the shape of the stair tread cover in a bent and/or biased position. For example, in non-limiting configuration, the stair tread cover includes one or more folds and/or bends wherein each of the folds and/or bends can position a portion of the stair tread cover horizontally and another portion of the stair tread cover vertically such as, for example, around a stair nosing. In such a configuration, when a reinforcement strip is applied at or near the stair nosing, the reinforcement strip can: i) provide improved stability and/or durability at or near the stair nosing, and/or ii) at least partially help retain the bend and/or folded shape of the stair tread cover such that the stair tread cover can fit snugly around the stair nosing. It can be appreciated that the reinforcement strip can have other or alternative uses.

The width and thickness of the at least one reinforcement strip 138, 140 is non-limiting. Generally, the width of the reinforcement strip is 0.25-5 inches and all values and ranges there between (e.g., 1 inch, 2 inches, 2.5 inches, etc.). The thickness of the reinforcement strip is generally less than 0.2 inches (e.g., 0.003-0.1 inches). A first reinforcement strip can optionally be positioned at or near the first fold 122 in the stair tread cover to provide an area of reinforcement at or near the step nosing (the most frequently contacted part of the step). As can be appreciated, one or more additional reinforcement strips can be positioned adjacent to the first reinforcement strip of the stair tread cover. The stair tread cover can include one, two, or more reinforcement strips. In one non-limiting arrangement, the stair tread cover includes one reinforcement strip positioned on a top surface of the stair tread cover. As can be appreciated, the stair tread cover can include one or more reinforcement strips positioned to correspond to other portions of steps (e.g., stair risers, stair nosing, etc.) which may be in contact with a user or equipment. In another and/or alternative non-limiting configuration, a reinforcement strip is optionally generally positioned at or within 0-2 inches of each fold of the stair tread cover. In another and/or alternative non-limiting configuration, a reinforcement strip is optionally generally positioned at or near the perimeter of the stair tread cover.

Figure 13:
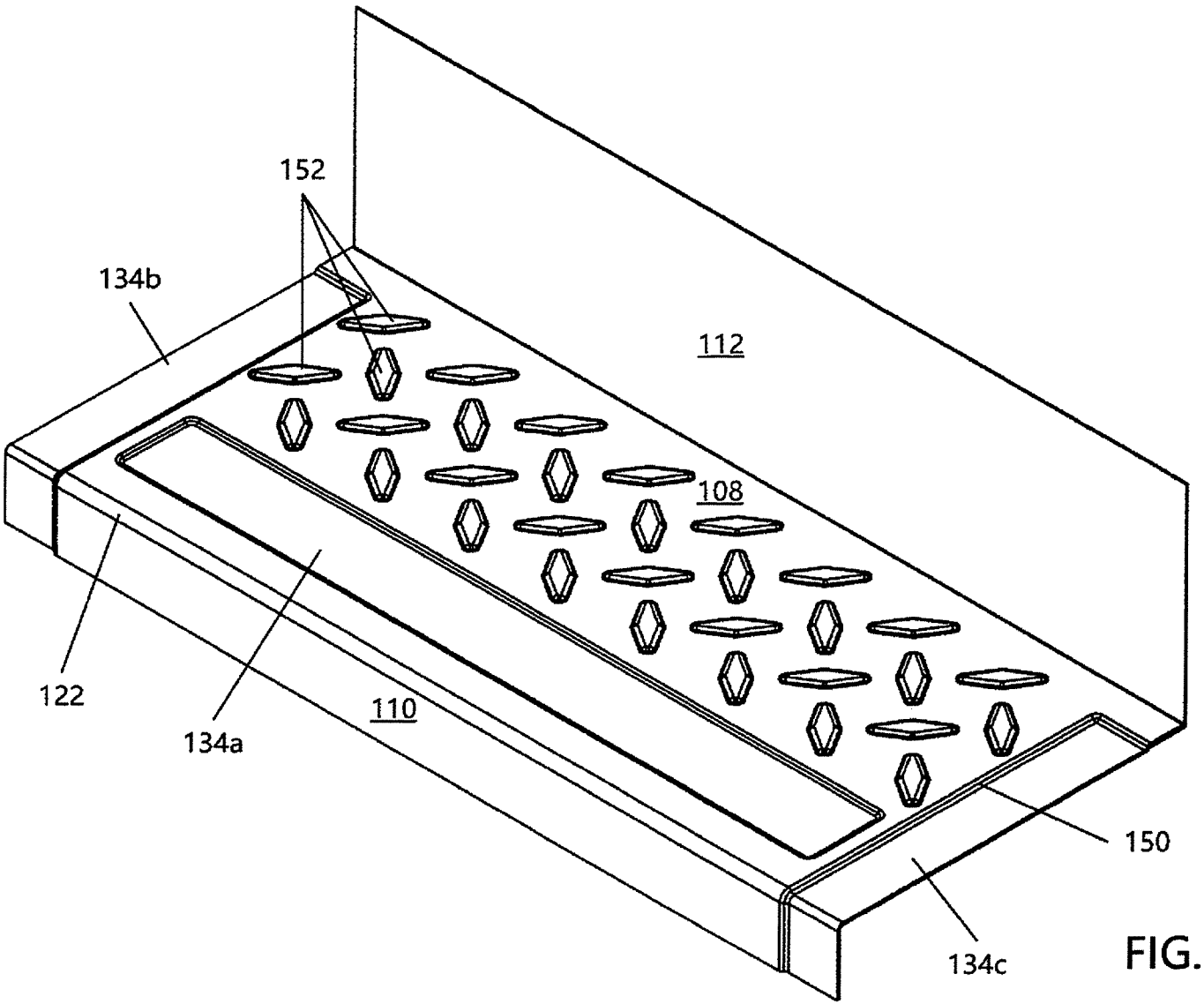
FIG. 13 is an illustration showing additional features of the stair tread cover of FIG. 11 in accordance with the present invention, where the two or more pieces of material are in an attached configuration.

In another and/or alternative non-limiting aspect of the present invention, the front portion 104 of the presently described stair tread cover optionally includes at least one portion of an increased thickness, such as portion 150 illustrated on the stair tread cover 300 of FIG. 13. The increased thickness portion 150 (when used) can be formed from the application of one or more layers of the first material. Furthermore, the increased thickness portion 150 (when used) may improve the rigidity and durability of the stair tread cover.

In another and/or alternative non-limiting aspect of the present invention, the front portion 104 of the stair tread cover optionally includes a plurality of surface projections 152 on the stair tread cover 300 as illustrated in FIGS. 11-16, for example. The one or more surface projections 152 (when used) may be provided to at least partially improve traction as a user walks over the stair tread cover. The size, shape, and quantity of surface projections is non-limiting. Thus, when the one or more surface projections 152 are used, a user's traction may be improved. The surface projections can be embossed in the stair tread cover and/or be adhesively applied, coated or otherwise attached to the top surface of the front portion of the stair tread cover.

In another and/or alternative non-limiting aspect of the present invention, the back portion 106 of the stair tread covers 100, 200, 300 optionally includes a second crease 142. The second crease 142 (when used) allows the back portion of the stair tread cover to be bent and/or folded along the crease. As can be appreciated, the number of creases is non-limited. The one or more creases can be used to adjust the height of the back portion to fit under different height stairs. In one non-limiting configuration, the back portion 106 of the stair tread covers includes a second crease 142, wherein the second crease is offset a distance inward from the end of the sheet of material. As such, in embodiments where the stair tread cover is made from a single piece of material, such as cover 100 illustrated in FIGS. 1-8, the back portion 106 of the stair tread cover can be folded along the second crease 142 so as to create the first or horizontal top panel 108 and the third or vertical stair riser panel 112 on either side of the first crease. In embodiments where the stair tread cover is made from two or more pieces of material, such as covers 200, 300 illustrated in FIGS. 9-16, the back portion 106 can be folded along the second crease 142 so as to create a first vertical stair riser panel 112*a* and a second horizontal stair riser panel 112*b* on either side of the second crease. In one specific non-limiting configuration, the back portion 106 of the stair tread covers 100, 200, and 300 is folded along the second crease 142 such that the back portion 106 is about 60-120°, and typically substantially perpendicular (e.g., 85-95°) to the first panel 108 of the front portion 104; however, other angles can be used.

In such embodiments where the stair tread cover is made from two or more pieces of material, the second horizontal stair riser panel 112*b* of the back portion 106 of the stair tread cover may be provided to: 1) protect a portion of the top tread surface of the step, and/or 2) provide a connection to the front portion 104 of the stair tread cover. Similarly, the first vertical stair riser panel 112*a* of the back portion 106 of the stair tread cover may be provided to protect the stair riser of a step. In one non-limiting configuration, the horizontal panel 112*b* is generally perpendicular (e.g., 85-95°) to the vertical panel 112*a* during use of the stair tread cover on a stair.

In any of the exemplary embodiments described herein, the second crease 142 can be located on either the top 114 or bottom surface 116 of the back portion 106 of the stair tread covers. The second crease 142 generally includes a respective offset from an end of the sheet of material. In one non-limiting arrangement, the second crease 142 is parallel to one end of the sheet of material. The second crease can optionally be perforated and/or water resistant. In another non-limiting configuration, the back portion 106 of the stair tread cover optionally includes an additional area 144 for additional creases 146, as shown on the cover 100 illustrated in FIGS. 3 and 4. Based on the depth of a particular stair, the stair tread cover can be bent at one of the creases (i.e., second crease 142 or additional crease 146) that provides a depth of the stair tread cover that best matches the depth of the stair.

A creasing wheel can optionally be used to form the one or more creases in the material of the stair tread cover. The scoring in the material includes a depth from about 5% to about 30% of a depth of the sheet of material, typically about 10-20% of a depth of the sheet of material. In one non-limiting arrangement, the scoring in the sheet of material includes a depth from about 14.5% of the sheet material. Generally, the depth of the crease is constant along the length of the crease.

The term 'crease' as used herein includes scoring or perforating the surface of the sheet of material. As such, the presently described stair tread covers 100, 200, 300 can provide simultaneous horizontal (i.e. stair tread, stair nosing) and vertical (i.e. stair riser, stair nosing) protection within a single product. The crease (when used) is generally positioned 0.5 to 12 inches (and all values and ranges therebetween) from a first end of the sheet of material. When the first crease is formed generally parallel to an end of the sheet of material, the crease is generally spaced about 0.5-12 inches from the end of the sheet of material, typically 1-10 inches, more typically about 1.25-8 inches, and still more typically 1.5-6 inches.

In another and/or alternative non-limiting aspect of the present invention, the vertical panel 112 of the back portion 106 of the exemplary stair tread covers can optionally include one or more temporary friction regions (not shown) applied thereto. The friction regions (when used) can be the same or different as the friction regions described above with reference to the first portion 104 of the stair tread covers. The one or more friction regions (when used) may be provided on the vertical panel 112 of the back portion 106 for the optional purpose of inhibiting or preventing the vertical portion of the stair tread cover from collapsing over the front portion 104 of the stair tread cover and exposing the stair riser.

Figure 17A:
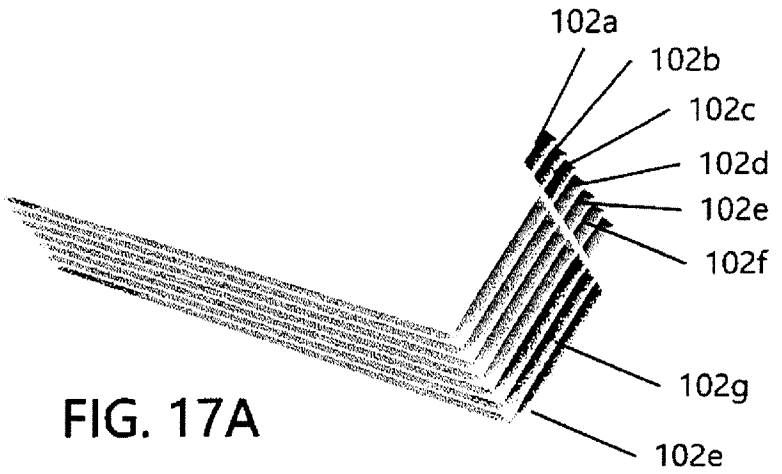
FIGS. 17A-17B illustrate additional features of the stair tread covers of FIGS. 1, 9, and 11 in accordance with the present invention, wherein a plurality of stair tread covers are shown; and, FIG. 18 is an illustration showing additional features of the stair tread covers of FIGS. 1, 9, and 11 in accordance with the present invention.
Figure 17B:
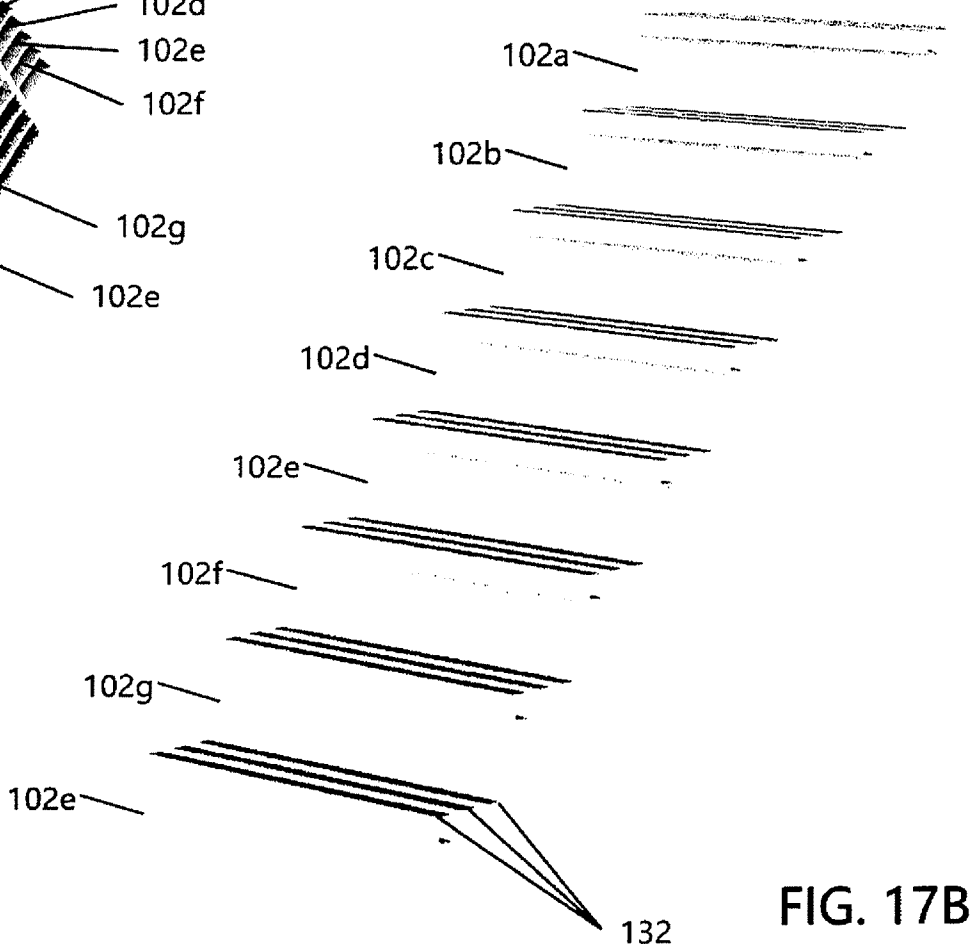
Figure 18:
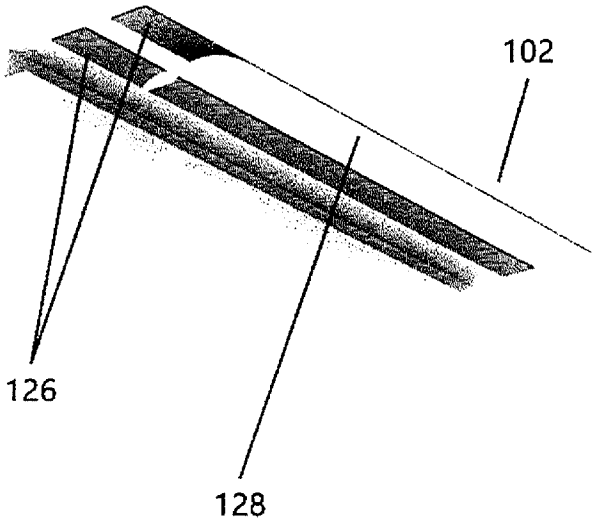

During installation, one or more stair tread covers in accordance with the present invention can be applied to one or more steps in a staircase. For example, as shown in FIGS. 17A-17B, a plurality of stair tread cover bodies 102*a*-102*e* can be provided. FIG. 17A illustrates the plurality of stair tread cover bodies 102*a*-102*e* as an exemplary product package containing multiple stair tread covers as described herein, and FIG. 17B illustrates the plurality of stair tread cover bodies 102*a*-102*e* being installed to multiple steps in a staircase. Initially, a first stair tread cover, such as cover body 102*a*, is positioned on a first step to be covered. After the first stair tread cover is positioned on the first step, a user can simply walk on the top surface of the stair tread cover in the area of the friction region on the stair tread cover to complete the temporary adhesive bonding or friction engagement of the stair tread cover to the stair tread. The vertical portion of the first stair tread cover can be folded upwardly as to be positioned along the stair riser of the first step. This process can then be repeated to secure additional stair tread covers 102*b*-102*e* to additional steps. For example, second stair tread cover body 102*b* can then be positioned on a second step to be covered. After the second stair tread cover body 102*b* is positioned on a second step, a user can simply walk on the top surface of the second stair tread cover in the area of the strip on the second stair tread cover to complete the temporary adhesive bonding or friction engagement of the stair tread cover to the stair tread. The vertical portion of the second stair tread cover can be folded upwardly as to be positioned along the stair riser of the second step.

The use of a pre-applied temporary friction region on the presently described stair tread covers 100, 200, 300 eliminates the need to apply a separate piece of tape or other adhesive over the edge of stair tread cover to maintain the stair tread cover on the step. Additionally, using a pre-applied temporary friction region also makes installation of the stair tread cover faster and easier.

One non-limiting advantage of the stair tread covers 100, 200, 300 of the present invention is that the stair tread covers offer protection to various parts of stairs within a single product. For example, the stair tread cover of the present invention protects the 1) stair tread, the actual step where a user places his/her foot as he/she walks thereon, 2) stair riser, a portion of a stair that is often kicked with a user's toe as the user walks up the stairs, and/or 3) stair nosing, the most often damaged portion of a stair.

In summary, the present invention is directed to stair tread covers 100, 200, 300 configured to protect selected portions of surfaces such as, for example, stairs. The stair tread covers can be sized to fit an individual step in a standard flight of stairs; however, the stair tread cover can be configured to accommodate non-standard flights of stairs (e.g. non-linear staircases, spiral staircases, etc.). The stair tread covers can be a non-reusable (i.e. one-time use) surface protector. As can be appreciated, the stair tread covers of the present invention can be used multiple times. In one non-limiting configuration, the stair tread covers 100, 200, 300 comprise a front portion and a back portion. The front portion of the stair tread covers can further comprise a first sheet of material having a perimeter, a top surface and a bottom surface. Similarly, the back portion of the stair tread cover can further comprise a second sheet of material having a perimeter, a top surface and a bottom surface. As can be appreciated, the stair tread covers can also be formed of a single sheet of material. The stair tread covers optionally include at least one friction region and optionally at least one gripping region. The friction region(s) are generally positioned on a first surface of the first sheet material so as to correspond to a stair tread. Likewise, the gripping region(s) are generally positioned on a second surface of the first sheet of material so as to correspond with a surface on which a user walks. The back portion of the stair tread cover optionally includes at least one crease, the at least one crease configured to allow the second sheet of material to be bent.

In another and/or alternative non-limiting aspect of the present invention, there is provided a method of forming the exemplary stair tread cover 100 described above. The method can comprise the steps of: 1) providing a sheet of material having a perimeter, 2) machine-forming the sheet of material so as to form a first portion of the stair tread cover which complements at least the size and shape of a stair tread of a step in a staircase, 3) machine-forming the sheet of material so as to form the first portion of the stair tread cover having a portion which complements at least the size and shape of a stair nosing of a step in a staircase, and/or 4) machine-forming the sheet of material so as to form a second portion of the stair tread cover which complements at least the size and shape of at least a stair riser of the step in the staircase.

In another and/or alternative non-limiting aspect of the present invention, there is provided a method of forming the exemplary stair tread covers 200, 300 described above. The method can comprise the steps of: 1) providing a first sheet of material having a perimeter, 2) machine-forming the first sheet of material so as to form a first portion of the stair tread cover which complements at least the size and shape of a stair tread of a step in a staircase, 3) providing a second sheet of material having a perimeter, 4) machine-forming the second sheet of material so as to form a second portion of the stair tread cover which complements the size and shape of at least a stair riser of the step in the staircase, and/or 5) connecting the second sheet of material to the first sheet of material to form the stair tread cover. The connection between the first and second sheets of material is non-limiting. For example, a non-releasable adhesive may be used to connect the first and second sheets of material.

The step of machine-forming the sheet or the first sheet of material can further optionally include the step of impressing the sheet material to form a recessed zone on the top surface of the sheet material, wherein the recessed zone is suitable for attachment of a gripping region such as a grip strip or grip coating.

The methods described above can also comprise the steps of: a) applying one or more friction regions to a bottom surface of the front portion of the stair tread cover, and/or b) applying one or more gripping regions to a top surface of the front portion of the stair tread cover. The gripping region can optionally be applied within the recessed zone on the top surface of the front portion of the stair tread cover. Optionally, the method can further include the step of applying a friction region to a back surface of the back portion of the stair tread cover to provide a temporary bond or friction engagement between the stair tread cover and a stair riser.

As can be appreciated, the stair tread cover can be formed of a single piece of material that is preformed and cut into shape.

The size of the stair tread cover of the present invention is non-limiting. In one non-limiting configuration, the vertical height of the stair tread cover is about 2 inches to about 20 inches, more typically about 3-10 inches, and more typically about 4-8 inches. In one specific non-limiting configuration, the stair tread cover is 6 inches in height. In another and/or alternative non-limiting configuration, the width of the stair tread cover is about 2 inches to about 48 inches, more typically about 4-36 inches, and more typically about 6-24 inches. In one specific non-limiting configuration, the width of the stair tread cover is about 10-11 inches.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed:

1. A method for providing temporary protection to a top surface of one or more stairs, each of said stairs includes a stair tread having a stair tread nose and a stair riser and wherein the stair tread nose extends over the stair riser, wherein the method comprises:

a. providing a first stair tread cover, said first stair tread cover configured to at least partially cover a first stair in a staircase, said first stair tread cover comprising a sheet of material and a pre-applied position-retaining material connected to said sheet of material; said sheet of material formed of a material selected from the group consisting of paperboard, fiberboard, and cardboard; said sheet of material is a single sheet; said sheet of material having a top surface, a bottom surface, a front edge, a back edge, a first side edge, and a second side edge; said sheet of material including a first preformed crease and a second preformed crease, both said first preformed crease and said second preformed crease extending between said first side edge and said second side edge; said first preformed crease and said second preformed crease positioned parallel to one another, said first preformed crease and said second preformed crease positioned parallel to said front edge and said back edge of said sheet of material; said sheet of material configured to be foldable along said first preformed crease and said second preformed crease; said sheet of material including a first panel, a second panel and a third panel; said second panel having a longitudinal length that extends from said front edge of said sheet of material to said first preformed crease; said third panel having a longitudinal length that extends from said back edge of said sheet of material to said second preformed crease; said first panel having a longitudinal length that extends from said first preformed crease to said second preformed crease; said second preformed crease positioned on said top surface of said sheet of material; said first preformed crease formed by a first depression in said top surface or said bottom surface of said sheet material; said second preformed crease formed by a second depression in said top surface of said sheet material; said first panel and said third panel configured to be foldable relative to one another; said first panel configured to be placed over a top surface of the stair tread of said first step; said second panel configured to be positioned at least partially about an outer front surface of the stair tread nose of said first step when said first panel is placed over the top surface of the stair tread of said first step and said second panel is folded downwardly along said first preformed crease; said third panel configured to be positioned at least partially over a front surface of the stair riser of said first step when said first panel is placed over the top surface of the stair tread of said first step and said third panel is folded upwardly along said second preformed crease; said top plane of said first panel and a top plane of said second panel in a non-planar relationship to one another when said first panel is placed over the top surface of the stair tread of said first step and said second panel is positioned at least partially about the outer front surface of the stair tread nose of said first step and said second panel is folded downwardly along said first preformed crease; said first, second and third panels having a same width; said pre-applied position-retaining d material connected to said bottom side of said sheet of material; said pre-applied position-retaining material configured to facilitate in temporarily maintaining said stair tread cover in position on the stair when said first panel is placed over the top surface of the stair tread of said first step; said pre-applied position-retaining material positioned on said first panel and spaced from said second panel and said third panel; said pre-applied position-retaining material extends between said first side edge and said second side edge of said sheet of material; said pre-applied position-retaining material covering 5-100% of said bottom surface of said first panel; and b. placing said first stair tread cover on said first stair such that i) said bottom surface of said first panel of said first stair tread cover is positioned over said top surface of said stair tread of said first stair and said pre-applied position-retaining material engages said top surface of said stair tread said first stair to form a temporary bond or friction engagement between said bottom surface of said first panel of said first stair tread cover and said top surface of said stair tread of said first stair, and ii) the bottom surface of said third panel of said first stair tread cover is positioned on or adjacent to the front surface of said stair riser of said first stair, and wherein a top surface of said first panel of said first stair tread cover and a top surface of said third panel of said first stair tread cover lie in a plane, and wherein an angle between said planes of said top surface of said first panel of said first stair tread cover and of said top surface of said third panel of said first stair tread cover is 60-120° after said first stair tread cover is temporarily positioned on said first stair.

2. The method as defined in claim 1, wherein said pre-applied position-retaining material on said bottom surface of said first panel of said first stair tread cover is pre-applied and includes a pre-applied removable protective release liner that covers a top surface of said pre-applied position-retaining material, and further includes the step of removing said removable protective release liner from said pre-applied position-retaining material to expose said top surface of said pre-applied position-retaining material prior to placing said first stair tread cover on said first stair.

3. A method for providing temporary protection to a top surface of one or more stairs, each of said stairs includes a stair tread having a stair tread nose and a stair riser and wherein the stair tread nose extends over the stair riser, wherein said method comprises:

a. providing a first stair tread cover, said first stair tread cover configured to at least partially cover a first stair in a staircase, said first stair tread cover comprising a sheet of material and a pre-applied position-retaining material connected to said sheet of material; said sheet of material formed of a material selected from the group consisting of paperboard, fiberboard, and cardboard; said sheet of material is a single sheet; said sheet of material is absent slots; said sheet of material having a top surface, a bottom surface, a front edge, a back edge, a first side edge, and a second side edge; said sheet of material including a first preformed crease and a second preformed crease, both said first preformed crease and said second preformed crease fully extending between said first side edge and said second side edge; said first preformed crease and said second preformed crease positioned parallel to one another, said first preformed crease and said second preformed crease positioned parallel to said front edge and said back edge of said sheet of material; said sheet of material having a width of 4-36 inches extending between said first side edge and said second side edge; said sheet of material having a longitudinal length of 2-20 inches extending between said front edge and said back edge; said first preformed crease spaced about 1.5-6 inches from said front edge of said sheet of material; said second preformed crease spaced about 1.25-8 inches from said back edge of said sheet of material; said sheet of material configured to be foldable along said first preformed crease and said second preformed crease; said sheet of material including a first panel, a second panel and a third panel; said second panel having a longitudinal length extending from said front edge of said sheet of material to said first preformed crease; said third panel having a longitudinal length extending from said back edge of said sheet of material to said second preformed crease; said first panel having a longitudinal length that extends from said first preformed crease to said second preformed crease; said first panel absent any preformed crease between said first and second preformed creases; said second panel absent any preformed crease between said front edge of said sheet of material to said first preformed crease; said second preformed crease positioned on said top surface of said sheet of material; said first preformed crease formed by a first depression in said top surface or said bottom surface of said sheet material and said first preformed crease having a depth of 5-30% of a thickness of said sheet material; said second preformed crease formed by a second depression in said top surface of said sheet material and said second preformed crease having a depth of 5-30% of said thickness of said sheet material; said first panel and said third panel are configured to be foldable relative to one another; said first, second and third panels having a same width; said longitudinal length of said second panel less than said longitudinal length of said first panel; said longitudinal length of said third panel less than said longitudinal length of said first panel; said longitudinal length of said second panel less than said longitudinal length of said third panel; said first panel and said second panel having the same thickness; said pre-applied position-retaining material connected to said bottom side of said sheet of material; said pre-applied position-retaining material configured to facilitate in temporarily maintaining said stair tread cover in position on the stair when said first panel is placed over the top surface of the stair tread; said pre-applied position-retaining material positioned on said first panel and spaced from said second panel and said third panel; said pre-applied position-retaining material extending between said first side edge and said second side edge of said sheet of material and is positioned parallel to said front edge and said back edge of said sheet of material; said pre-applied position-retaining material having a thickness of less than 0.25 inches; said pre-applied position-retaining material having a width of 0.25-5 inches;

b. placing said first stair tread cover on said first step such that i) said bottom surface of said first panel of said first stair tread cover is positioned over at least a portion of said top surface of said stair tread of said first step and said pre-applied position-retaining material of said first stair tread cover engages said top surface of said stair tread of said first step to provide a temporary, non-slip contact between said top surface of said stair tread of said first step and said bottom surface of said first panel of said first stair tread cover, ii) a bottom surface of said third panel of said first stair tread cover is positioned at least partially on or adjacent to a front surface of said stair riser of said first step when said first panel of said first stair tread cover is placed over said top surface of said stair tread of said first step and said third panel of said first stair tread cover is folded upwardly along said second preformed crease of said first stair tread cover, iii) and a bottom surface of said second panel of said first stair tread cover is positioned at least partially about an outer front surface of the stair tread nose of said first step when said first panel of said first stair tread cover is placed over said top surface of said stair tread of said first step and said second panel of said first stair tread cover is folded downwardly along said first preformed crease of said first stair tread cover; and wherein a top surface of said first panel of said first stair tread cover and a top surface of said third panel of said first stair tread cover lie in a plane, and wherein an angle between said planes of said top surface of said first and third panels is 60-120°; and wherein said top plane of said first panel and a top plane of said second panel are in a non-planar relationship to one another.

4. The method as defined in claim 3, wherein said sheet of material of said first stair tread cover includes no more than three preformed creases, said third panel of said first stair tread cover includes a third preformed crease, said third preformed crease positioned between said back edge of said sheet of material of said first stair tread cover and said second preformed crease, said third preformed crease positioned parallel to said second preformed crease.

5. The method as defined in claim 4, wherein said pre-applied position-retaining material of said first stair tread cover includes a pre-applied adhesive surface and a pre-applied release liner that is removably connected to said adhesive surface, and further includes the step of removing said release liner from said pre-applied position-retaining material to expose said top surface of said pre-applied position-retaining material prior to placing said first stair tread cover on said first stair.

6. The method as defined in claim 5, wherein said method further includes the step of providing a second stair tread cover, said first and second stair tread covers having the same configuration, and further including the step of placing said second stair tread cover on a second step such that i) said bottom surface of said first panel of said second stair tread cover is positioned over at least a portion of said top surface of said stair tread of said second step and said pre-applied position-retaining material of said second stair tread cover engages said top surface of said stair tread of said second step to provide a temporary, non-slip contact between said top surface of said stair tread of said second step and said bottom surface of said first panel of said second stair tread cover, ii) a bottom surface of said third panel of said second stair tread cover is positioned at least partially on or adjacent to a front surface of said stair riser of said second step when said first panel of said second stair tread cover is placed over said top surface of said stair tread of said second step and said third panel of said second stair tread cover is folded upwardly along said second preformed crease of said second stair tread cover, iii) and a bottom surface of said second panel of said second stair tread cover is positioned at least partially about an outer front surface of the stair tread nose of said second step when said first panel of said second stair tread cover is placed over said top surface of said stair tread of said second step and said second panel of said second stair tread cover is folded downwardly along said first preformed crease of said second stair tread cover.

7. The method as defined in claim 3, wherein said pre-applied position-retaining material of said first stair tread cover includes a pre-applied adhesive surface and a pre-applied release liner that is removably connected to said adhesive surface, and further includes the step of removing said release liner from said pre-applied position-retaining material to expose said top surface of said pre-applied position-retaining material prior to placing said first stair tread cover on said first stair.

8. The method as defined in claim 3, wherein said method further includes the step of providing a second stair tread cover, said first and second stair tread covers having the same configuration, and further including the step of placing said second stair tread cover on a second step such that i) said bottom surface of said first panel of said second stair tread cover is positioned over at least a portion of said top surface of said stair tread of said second step and said pre-applied position-retaining material of said second stair tread cover engages said top surface of said stair tread of said second step to provide a temporary, non-slip contact between said top surface of said stair tread of said second step and said bottom surface of said first panel of said second stair tread cover, ii) a bottom surface of said third panel of said second stair tread cover is positioned at least partially on or adjacent to a front surface of said stair riser of said second step when said first panel of said second stair tread cover is placed over said top surface of said stair tread of said second step and said third panel of said second stair tread cover is folded upwardly along said second preformed crease of said second stair tread cover, iii) and a bottom surface of said second panel of said second stair tread cover us positioned at least partially about an outer front surface of the stair tread nose of said second step when said first panel of said second stair tread cover is placed over said top surface of said stair tread of said second step and said second panel of said second stair tread cover is folded downwardly along said first preformed crease of said second stair tread cover.

9. A method for providing temporary protection to a top surface of one or more stairs, each of said stairs includes a stair tread having a stair tread nose and a stair riser and wherein the stair tread nose extends over the stair riser, wherein the method comprises:

a. providing a first stair tread cover, said first stair tread cover configured to at least partially cover a first stair in a staircase, said first stair tread cover comprising a sheet of material and a first pre-applied position-retaining material connected to said sheet of material; said sheet of material formed of a material selected from the group consisting of paperboard, fiberboard, and cardboard; said sheet of material is absent slots; said sheet of material having a top surface, a bottom surface, a front edge, a back edge, a first side edge, and a second side edge; said sheet of material including a first preformed crease and a second preformed crease, both said first crease and said second preformed crease extending between said first side edge and said second side edge; said first preformed crease and said second preformed crease positioned parallel to one another, said first preformed crease and said second preformed crease positioned parallel to said front edge and said back edge of said sheet of material; said sheet of material configured to be foldable along said first preformed crease and said second preformed crease; said sheet of material including a first panel, a second panel and a third panel; said second panel having a longitudinal length extending from said front edge of said sheet of material to said first preformed crease; said third panel having a longitudinal length that extends from said back edge of said sheet of material to said second preformed crease; said first panel having a longitudinal length extending from said first preformed crease to said second preformed crease; said first panel absent any crease between said first and second preformed creases; said second panel absent any preformed crease between said front edge of said sheet of material to said first preformed crease; said second preformed crease positioned on said top surface of said sheet of material; said first preformed crease formed by i) a first depression in said top surface or said bottom surface of said sheet material and said first preformed crease having a depth of 5-30% of a thickness of said sheet material, ii) first perforations in said top surface or said bottom surface of said sheet material, or combinations thereof; said second preformed crease formed i) by a second depression in said top surface of said sheet material and said second preformed crease having a depth of 5-30% of said thickness of said sheet material ii) second perforations in said top surface or said bottom surface of said sheet material, or combinations thereof; said first panel and said third panel configured to be foldable relative to one another; said first pre-applied position-retaining material connected to said bottom side of said sheet of material; said first pre-applied position-retaining material configured to facilitate in temporarily maintaining said stair tread cover in position on the stair when said first panel is placed over the top surface of the stair tread; said first pre-applied position-retaining material positioned on said first panel and spaced from said second panel and said third panel; said first stair tread cover including three of more features selected from the group consisting of a) one or more reinforcement strips positioned on and connected to at least a portion of said first and second panels; b) one or more reinforcement strips positioned on and connected to at least a portion of said first and third panels; c) a second said pre-applied position-retaining material positioned on a portion of a bottom surface of said first panel of said first stair tread cover, said second pre-applied position-retaining material configured to provide a temporary, non-slip contact between said top surface of said stair tread of said first stair and said bottom surface of said first panel of said first stair tread cover, second pre-applied position-retaining material spaced from said second and third panels of said first stair tread cover; d) at least a portion of said first panel having an increased thickness, e) said top surface of said first panel of said first stair tread cover including a first gripping region; f) said top surface of said first panel of said first stair tread cover including first and second gripping regions; g) said top surface of said first panel of said first stair tread cover including printing to provide information to a user for where the user is recommended to walk on said top surface of said first panel said first stair tread cover; h) said top surface of said first panel of said first stair tread cover including one or more recesses configured to receive material that forms a gripping region; i) said bottom surface of said first panel of said first stair tread cover including a recess configured to receive said first pre-applied position-retaining material; j) said sheet of material of said first stair tread cover having a width of 4-36 inches that extends between said first side edge and said second side edge; k) said sheet of material of said first stair tread cover having a longitudinal length of 2-20 inches extending between said front edge and said back edge;

1) said first preformed crease of said first stair tread cover spaced about 1.5-6 inches from said front edge of said sheet of material of said first stair tread cover; m) said second preformed crease of said first stair tread cover spaced about 1.25-8 inches from said back edge of said sheet of material of said first stair tread cover; n) said first, second and third panels of said first stair tread cover having a same width; o) said longitudinal length of said second panel of said first stair tread cover less than said longitudinal length of said first panel of said first stair tread cover; p) said longitudinal length of said third panel of said first stair tread cover less than said longitudinal length of said first panel of said first stair tread cover; q) said longitudinal length of said second panel of said first stair tread cover less than said longitudinal length of said third panel of said first stair tread cover; r) said first panel and said second panel of said first stair tread cover having the same thickness; s) said first panel, said second panel and said third panel of said first stair tread cover having the same thickness; t) said first pre-applied position-retaining material of said first stair tread cover extending between said first side edge and said second side edge of said sheet of material of said first stair tread cover and positioned parallel to said front edge and said back edge of said sheet of material of said first stair tread cover; u) said first pre-applied material of said first stair tread cover having a thickness of less than 0.25 inches; v) said first position-retaining material of said first stair tread cover having a width of 0.25-5 inches; w) said sheet of material of said first stair tread cover is a single sheet; and x) both said first preformed crease and said preformed second crease fully extend between said first side edge and said second side edge;

b. placing said first stair tread cover on said first step such that i) said bottom surface of said first panel of said first stair tread cover is positioned over at least a portion of said top surface of said stair tread of said first step and said pre-applied position-retaining material of said first stair tread cover engages said top surface of said stair tread of said first step to provide a temporary, non-slip contact between said top surface of said stair tread of said first step and said bottom surface of said first panel of said first stair tread cover, ii) a bottom surface of said third panel of said first stair tread cover is positioned at least partially on or adjacent to a front surface of said stair riser of said first step when said first panel of said first stair tread cover is placed over said top surface of said stair tread of said first step and said third panel of said first stair tread cover is folded upwardly along said second preformed crease of said first stair tread cover, and iii) a bottom surface of said second panel of said first stair tread cover is positioned at least partially about an outer front surface of the stair tread nose of said first step when said first panel of said first stair tread cover is placed over said top surface of said stair tread of said first step and said second panel of said first stair tread cover is folded downwardly along said first preformed crease of said first stair tread cover; and wherein a top surface of said first panel of said first stair tread cover and a top surface of said third panel of said first stair tread cover lie in a plane, and wherein an angle between said planes of said top surface of said first and third panels is 60-120°; and wherein said top plane of said first panel and a top plane of said second panel are in a non-planar relationship to one another.

10. The method as defined in claim 9, wherein said sheet of material of said first stair tread cover includes no more than three preformed creases, said third panel of said first stair tread cover includes a third preformed crease, said third preformed crease positioned between said back edge of said sheet of material of said first stair tread cover and said second preformed crease, said third preformed crease positioned parallel to said second preformed crease.

11. The method as defined in claim 10, wherein said pre-applied position-retaining material of said first stair tread cover includes a pre-applied adhesive surface and a pre-applied release liner that is removably connected to said adhesive surface, and further includes the step of removing said release liner from said pre-applied position-retaining material to expose said top surface of said pre-applied position-retaining material prior to placing said first stair tread cover on said first stair.

12. The method as defined in claim 11, said method further includes the step of providing a second stair tread cover, said first and second stair tread covers having the same configuration, and further including the step of placing said second stair tread cover on a second step such that i) said bottom surface of said first panel of said second stair tread cover is positioned over at least a portion of said top surface of said stair tread of said second step and said pre-applied position-retaining material of said second stair tread cover engages said top surface of said stair tread of said second step to provide a temporary, non-slip contact between said top surface of said stair tread of said second step and said bottom surface of said first panel of said second stair tread cover, ii) a bottom surface of said third panel of said second stair tread cover is positioned at least partially on or adjacent to a front surface of said stair riser of said second step when said first panel of said second stair tread cover is placed over said top surface of said stair tread of said second step and said third panel of said second stair tread cover is folded upwardly along said second preformed crease of said second stair tread cover, and iii) a bottom surface of said second panel of said second stair tread cover is positioned at least partially about an outer front surface of the stair tread nose of said second step when said first panel of said second stair tread cover is placed over said top surface of said stair tread of said second step and said second panel of said second stair tread cover is folded downwardly along said first preformed crease of said second stair tread cover.

13. The method as defined in claim 10, wherein said method further includes the step of providing a second stair tread cover, said first and second stair tread covers having the same configuration, and further including the step of placing said second stair tread cover on a second step such that i) said bottom surface of said first panel of said second stair tread cover is positioned over at least a portion of said top surface of said stair tread of said second step and said pre-applied position-retaining material of said second stair tread cover engages said top surface of said stair tread of said second step to provide a temporary, non-slip contact between said top surface of said stair tread of said second step and said bottom surface of said first panel of said second stair tread cover, ii) a bottom surface of said third panel of said second stair tread cover is positioned at least partially on or adjacent to a front surface of said stair riser of said second step when said first panel of said second stair tread cover is placed over said top surface of said stair tread of said second step and said third panel of said second stair tread cover is folded upwardly along said second preformed crease of said second stair tread cover, and iii) a bottom surface of said second panel of said second stair tread cover is positioned at least partially about an outer front surface of the stair tread nose of said second step when said first panel of said second stair tread cover is placed over said top surface of said stair tread of said second step and said second panel of said second stair tread cover is folded downwardly along said first preformed crease of said second stair tread cover.

14. The method as defined in claim 9, wherein said pre-applied position-retaining material of said first stair tread cover includes a pre-applied adhesive surface and a pre-applied release liner that is removably connected to said adhesive surface, and further includes the step of removing said release liner from said pre-applied position-retaining material to expose said top surface of said pre-applied position-retaining material prior to placing said first stair tread cover on said first stair.

15. The method as defined in claim 9, wherein said method further includes the step of providing a second stair tread cover, said first and second stair tread covers having the same configuration, and further including the step of placing said second stair tread cover on a second step such that i) said bottom surface of said first panel of said second stair tread cover is positioned over at least a portion of said top surface of said stair tread of said second step and said pre-applied position-retaining material of said second stair tread cover engages said top surface of said stair tread of said second step to provide a temporary, non-slip contact between said top surface of said stair tread of said second step and said bottom surface of said first panel of said second stair tread cover, ii) a bottom surface of said third panel of said second stair tread cover is positioned at least partially on or adjacent to a front surface of said stair riser of said second step when said first panel of said second stair tread cover is placed over said top surface of said stair tread of said second step and said third panel of said second stair tread cover is folded upwardly along said second preformed crease of said second stair tread cover, iii) and a bottom surface of said second panel of said second stair tread cover is positioned at least partially about an outer front surface of the stair tread nose of said second step when said first panel of said second stair tread cover is placed over said top surface of said stair tread of said second step and said second panel of said second stair tread cover is folded downwardly along said first preformed crease of said second stair tread cover.

16. A method for providing temporary protection to a top surface of one or more stairs, wherein each of said stairs includes a stair tread having a stair tread nose and a stair riser and wherein the stair tread nose extends over the stair riser, wherein the method comprises:

a. providing a first stair tread cover, said first stair tread cover configured to at least partially cover a first stair in a staircase, said first stair tread cover consisting essentially of a single sheet of material and a single first pre-applied position-retaining material connected to said single sheet of material; said single sheet of material consisting essentially of cardboard; said single sheet of material absent slots; said single sheet of material having a top surface, a bottom surface, a front edge, a back edge, a first side edge, and a second side edge; said single sheet of material having no more than three preformed creases; said single sheet of material including a first preformed crease and a second preformed crease that both extend between said first side edge and said second side edge; said first preformed crease and said second preformed crease positioned parallel to one another, said first preformed crease and said second preformed crease positioned parallel to said front edge and said back edge of said sheet of material; said sheet of material configured to be foldable along said first preformed crease and said second preformed crease; said sheet of material consisting of a first panel, a second panel and a third panel; said second panel having a longitudinal length extending from said front edge of said sheet of material to said first preformed crease; said third panel having a longitudinal length extending from said back edge of said sheet of material to said second preformed crease; said first panel having a longitudinal length extending from said first preformed crease to said second preformed crease; said first panel absent any preformed crease between said first and second preformed creases; said second panel absent any preformed crease between said front edge of said sheet of material to said first preformed crease; said second preformed crease positioned on said top surface of said sheet of material; a distance of said first preformed crease from said front edge of said single sheet of material is less than a distance of said second preformed crease from said back edge of said single sheet of material; said first preformed crease formed by i) a first depression in said top surface or said bottom surface of said sheet material and said first preformed crease having a depth of 5-30% of a thickness of said sheet material, ii) first perforations in said top surface or said bottom surface of said sheet material, or combinations thereof; said second preformed crease formed i) by a second depression in said top surface of said sheet material and said second preformed crease having a depth of 5-30% of said thickness of said sheet material ii) second perforations in said top surface or said bottom surface of said sheet material, or combinations thereof; said first panel and said third panel configured to be foldable relative to one another; said single pre-applied position-retaining material connected to said bottom side of said sheet of material; said single pre-applied position-retaining material configured to facilitate in temporarily maintaining said stair tread cover in position on the stair when said first panel is placed over the top surface of the stair tread; said single pre-applied position-retaining material positioned on said first panel and spaced from said second panel and said third panel; said single sheet of material of said first stair tread cover having a width of 4-36 inches extending between said first side edge and said second side edge; said single sheet of material of said first stair tread cover having a longitudinal length of 2-20 inches extending between said front edge and said back edge; said first preformed crease of said first stair tread cover spaced about 1.5-6 inches from said front edge of said single sheet of material of said first stair tread cover; said second preformed crease of said first stair tread cover spaced about 1.25-8 inches from said back edge of said single sheet of material of said first stair tread cover; said first, second and third panels of said first stair tread cover having a same width; said longitudinal length of said second panel of said first stair tread cover less than said longitudinal length of said first panel of said first stair tread cover; said longitudinal length of said third panel of said first stair tread cover less than said longitudinal length of said first panel of said first stair tread cover; said longitudinal length of said second panel of said first stair tread cover less than said longitudinal length of said third panel of said first stair tread cover; said first panel, said second panel and said third panel of said first stair tread cover having the same thickness; said single pre-applied position-retaining material of said first stair tread cover extending between said first side edge and said second side edge of said sheet of material of said first stair tread cover and positioned parallel to said front edge and said back edge of said sheet of material of said first stair tread cover; said single pre-applied position-retaining material of said first stair tread cover having a thickness of less than 0.25 inches; said single pre-applied position-retaining material of said first stair tread cover having a width of 0.25-5 inches; both said first preformed crease and said second preformed crease fully extending between said first side edge and said second side edge;

b. placing said first stair tread cover on said first step such that i) said bottom surface of said first panel of said first stair tread cover is positioned over at least a portion of said top surface of said stair tread of said first step and said pre-applied position-retaining material of said first stair tread cover engages said top surface of said stair tread of said first step to provide a temporary, non-slip contact between said top surface of said stair tread of said first step and said bottom surface of said first panel of said first stair tread cover, said pre-applied position-retaining material configured to disengage from said top surface of said stair tread of said first step without damaging said top surface of said stair tread of said first step, ii) a bottom surface of said third panel of said first stair tread cover is positioned at least partially on or adjacent to a front surface of said stair riser of said first step when said first panel of said first stair tread cover is placed over said top surface of said stair tread of said first step and said third panel of said first stair tread cover is folded upwardly along said second preformed crease of said first stair tread cover, and iii) a bottom surface of said second panel of said first stair tread cover is positioned at least partially about an outer front surface of the stair tread nose of said first step when said first panel of said first stair tread cover is placed over said top surface of said stair tread of said first step and said second panel of said first stair tread cover is folded downwardly along said first preformed crease of said first stair tread cover; and wherein a top surface of said first panel of said first stair tread cover and a top surface of said third panel of said first stair tread cover lie in a plane, and wherein an angle between said planes of said top surface of said first and third panels is 60-120°; and wherein said top plane of said first panel and a top plane of said second panel are in a non-planar relationship to one another.

17. The method as defined in claim 16, wherein said third panel of said first stair tread cover includes a third preformed crease, said third crease preformed positioned between said back edge of said sheet of material of said first stair tread cover and said second preformed crease, said third preformed crease positioned parallel to said second preformed crease.

18. The method as defined in claim 17, wherein said pre-applied position-retaining material of said first stair tread cover includes an adhesive surface and a release liner that is removably connected to said adhesive surface, and further includes the step of removing said release liner from said pre-applied position-retaining material to expose said top surface of said pre-applied position-retaining material prior to placing said first stair tread cover on said first stair.

19. The method as defined in claim 18, wherein said top surface of said first panel of said first stair tread cover includes printing to provide information to a user for where the user is recommended to walk on said top surface of said first panel said first stair tread cover.

20. The method as defined in claim 19, said method further includes the step of providing a second stair tread cover, said first and second stair tread covers having the same configuration, and further including the step of placing said second stair tread cover on a second step such that i) said bottom surface of said first panel of said second stair tread cover is positioned over at least a portion of said top surface of said stair tread of said second step and said pre-applied position-retaining material of said second stair tread cover engages said top surface of said stair tread of said second step to provide a temporary, non-slip contact between said top surface of said stair tread of said second step and said bottom surface of said first panel of said second stair tread cover, ii) a bottom surface of said third panel of said second stair tread cover is positioned at least partially on or adjacent to a front surface of said stair riser of said second step when said first panel of said second stair tread cover is placed over said top surface of said stair tread of said second step and said third panel of said second stair tread cover is folded upwardly along said second preformed crease of said second stair tread cover, and iii) a bottom surface of said second panel of said second stair tread cover is positioned at least partially about an outer front surface of the stair tread nose of said second step when said first panel of said second stair tread cover is placed over said top surface of said stair tread of said second step and said second panel of said second stair tread cover is folded downwardly along said first preformed crease of said second stair tread cover.

21. The method as defined in claim 18, wherein said method further includes the step of providing a second stair tread cover, said first and second stair tread covers having the same configuration, and further including the step of placing said second stair tread cover on a second step such that i) said bottom surface of said first panel of said second stair tread cover is positioned over at least a portion of said top surface of said stair tread of said second step and said pre-applied position-retaining material of said second stair tread cover engages said top surface of said stair tread of said second step to provide a temporary, non-slip contact between said top surface of said stair tread of said second step and said bottom surface of said first panel of said second stair tread cover, ii) a bottom surface of said third panel of said second stair tread cover is positioned at least partially on or adjacent to a front surface of said stair riser of said second step when said first panel of said second stair tread cover is placed over said top surface of said stair tread of said second step and said third panel of said second stair tread cover is folded upwardly along said second preformed crease of said second stair tread cover, and iii) a bottom surface of said second panel of said second stair tread cover is positioned at least partially about an outer front surface of the stair tread nose of said second step when said first panel of said second stair tread cover is placed over said top surface of said stair tread of said second step and said second panel of said second stair tread cover is folded downwardly along said first preformed crease of said second stair tread cover.

22. The method as defined in claim 16, wherein said pre-applied position-retaining material of said first stair tread cover includes an adhesive surface and a release liner that is removably connected to said adhesive surface, and further includes the step of removing said release liner from said pre-applied position-retaining material to expose said top surface of said pre-applied position-retaining material prior to placing said first stair tread cover on said first stair.

23. The method as defined in claim 16, wherein said top surface of said first panel of said first stair tread cover includes printing to provide information to a user for where the user is recommended to walk on said top surface of said first panel said first stair tread cover.

24. The method as defined in claim 16, wherein said method further includes the step of providing a second stair tread cover, said first and second stair tread covers having the same configuration, and further including the step of placing said second stair tread cover on a second step such that i) said bottom surface of said first panel of said second stair tread cover is positioned over at least a portion of said top surface of said stair tread of said second step and said pre-applied position-retaining material of said second stair tread cover engages said top surface of said stair tread of said second step to provide a temporary, non-slip contact between said top surface of said stair tread of said second step and said bottom surface of said first panel of said second stair tread cover, ii) a bottom surface of said third panel of said second stair tread cover is positioned at least partially on or adjacent to a front surface of said stair riser of said second step when said first panel of said second stair tread cover is placed over said top surface of said stair tread of said second step and said third panel of said second stair tread cover is folded upwardly along said second preformed crease of said second stair tread cover, and iii) a bottom surface of said second panel of said second stair tread cover is positioned at least partially about an outer front surface of the stair tread nose of said second step when said first panel of said second stair tread cover is placed over said top surface of said stair tread of said second step and said second panel of said second stair tread cover is folded downwardly along said first preformed crease of said second stair tread cover.

25. A method for providing temporary protection to a top surface of one or more stairs, each of said stairs includes a stair tread having a stair tread nose and a stair riser and wherein the stair tread nose extends over the stair riser, wherein the method comprises:

a. providing a first stair tread cover, said stair tread cover comprising a sheet of material and a position-retaining material connected to said sheet of material; said sheet of material having a top surface, a bottom surface, a front edge, a back edge, a first side edge, and a second side edge; said sheet of material including a first crease and a second crease, both said first crease and said second crease extending between said first side edge and said second side edge; said first crease and said second crease positioned parallel to one another; said sheet of material configured to be foldable along said first crease and said second crease to form a first panel, a second panel and a third panel; said second panel having a longitudinal length that extends from said front edge of said sheet of material to said first crease; said third panel having a longitudinal length that extends from said back edge of said sheet of material to said second crease; said first panel having a longitudinal length that extends from said first crease to said second crease; said first and third panels configured to be foldable relative to one another; said first panel configured to be placed over a top surface of the stair tread; said second panel configured to be positioned at least partially about an outer front surface of the stair tread nose when said first panel is placed over the top surface of the stair tread; said third panel configured to be positioned at least partially over a front surface of the stair riser when said first panel is placed over the top surface of the stair tread; a non-parallel angle exists between top planes of said first and third panels when said first panel is placed over the top surface of the stair tread and said third panel is positioned at least partially over the front surface of the stair riser; said top plane of said first panel and a top plane of said second panel in a non-planar relationship to one another when said first panel is placed over the top surface of the stair tread and said second panel positioned at least partially about the outer front surface of the stair tread nose; said first, second and third panels having a same width; said longitudinal length of said second panel less than said longitudinal length of said first panel; said position-retaining material connected to said bottom side of said sheet of material, said position-retaining material configured to facilitate in temporarily maintaining said stair tread cover in position on the stair when said first panel is placed over the top surface of the stair tread, said position-retaining material positioned on said first panel; and b. placing said first stair tread cover on said first stair such that said bottom surface of said first panel of said first stair tread cover is positioned over said top surface of said stair tread of said first stair and said pre-applied position-retaining material at least partially engages said top surface of said stair tread said first stair to form a temporary bond or friction engagement between said bottom surface of said first panel of said first stair tread cover and said top surface of said stair tread of said first stair.

* * * * *